US009594340B2

(12) United States Patent
Fukumoto et al.

(10) Patent No.: US 9,594,340 B2
(45) Date of Patent: Mar. 14, 2017

(54) IMAGE FORMING APPARATUS INCLUDING A CONTROL UNIT FOR LUBRICANT AND IMAGE FORMING METHOD

(71) Applicant: Konica Minolta, Inc., Chiyoda-ku, Tokyo (JP)

(72) Inventors: Kazuko Fukumoto, Ibaraki (JP); Yuji Kamoda, Osaka (JP); Yasuo Shirodai, Hachioji (JP); Yuya Sato, Fuchu (JP); Kunitomo Sasaki, Takatsuki (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/995,746

(22) Filed: Jan. 14, 2016

(65) Prior Publication Data

US 2016/0209800 A1 Jul. 21, 2016

(30) Foreign Application Priority Data

Jan. 15, 2015 (JP) ..... 2015-006219

(51) Int. Cl.
*G03G 21/00* (2006.01)

(52) U.S. Cl.
CPC ..... *G03G 21/0094* (2013.01)

(58) Field of Classification Search
CPC ..... G03G 21/0094
USPC ..... 399/346
See application file for complete search history.

(56) References Cited

U.S. PATENT DOCUMENTS 4,870,466 A * 9/1989 Iida ..... G03G 21/10 15/1.52
6,006,062 A * 12/1999 Takahashi ..... G03G 15/1605 399/308
8,923,743 B2 * 12/2014 Suda ..... G03G 15/5008 184/17
2004/0100698 A1 5/2004 Aoki et al.
2013/0071163 A1 * 3/2013 Watanabe ..... G03G 15/0189 399/346

FOREIGN PATENT DOCUMENTS

JP H08-305236 A 11/1996
JP 2002-006689 A 1/2002
JP 2005-181742 A 7/2005

* cited by examiner

*Primary Examiner* — Quana M Grainger
(74) *Attorney, Agent, or Firm* — Buchanan Ingersoll & Rooney PC

(57) ABSTRACT

An image forming apparatus includes: an image bearing body; a developing unit which develops an electrostatic latent image formed on the image bearing body as a toner image; a transfer unit which transfers the toner image to a receiver medium; a cleaning member which collects residual toner on the image bearing body; a lubricant supply unit which supplies lubricant onto the image bearing body; a measurement unit which measures a static frictional force generated between the image bearing body and the cleaning member; and a control unit which corrects the amount of lubricant on the image bearing body, wherein the control unit estimates a state of the lubricant on the image bearing body based on a change between a first and a second static frictional force, and based on the estimated state, the control unit selectively executes one of processing of supplying lubricant and processing of removing lubricant.

16 Claims, 8 Drawing Sheets

IMAGE FORMING APPARATUS INCLUDING A CONTROL UNIT FOR LUBRICANT AND IMAGE FORMING METHOD

The entire disclosure of Japanese Patent Application No. 2015-006219 filed on Jan. 15, 2015 including description, claims, drawings, and abstract are incorporated herein by reference in its entirety.

BACKGROUND OF THE INVENTION

Field of the Invention

The present invention relates to an image forming apparatus having a function to supply lubricant onto an image bearing body, and also relates to an image forming method on the image forming apparatus.

Description of the Related Art

Electrophotographic type image forming apparatuses such as a multi-functional peripheral, copier, and a printer have been widely used. The electrophotographic type image forming apparatus as above typically includes an image bearing body, a transfer apparatus, and a cleaning member. The image bearing body is a component on which a toner image is formed while the image bearing body is being rotationally driven. The transfer apparatus transfers the formed toner image to a transfer body or a medium. The cleaning member collects, after the transfer of the toner image, the residual toner adhered to a surface of the image bearing body and then cleans the surface of the image bearing body.

As the image bearing body, a photoreceptor is employed. For the photoreceptor, execution of a cycle including a charging step, an exposure step, and a developing step, is repeated. In the charging step, a surface of the photoreceptor is charged uniformly. In the exposure step, a surface of the photoreceptor is exposed according to a specified image pattern so as to form an electrostatic latent image. In the developing step, toner is supplied to the surface of the photoreceptor so as to develop the electrostatic latent image.

In addition, it is typical that a lubricant supply mechanism is provided. The lubricant supply mechanism supplies lubricant onto the image bearing body for decreasing a frictional force generated between the cleaning member and the image bearing body. As a typical lubricant, a metal soap such as a metal stearate is employed. Various types of lubricant supply mechanisms are known. One type has an application mechanism including a brush, provided upstream or downstream of the cleaning member. Another type adds lubricant in the toner and supplies the lubricant at the developing unit. And yet another type combines these two types. In a configuration with the lubricant supply mechanism, lubricant is applied to a surface of the image bearing body, leading to a lowered friction coefficient for the toner on the surface of the image bearing body. The lowered friction coefficient suppresses a defective transfer when a toner image formed on the surface of the image bearing body is transferred to the transfer material, or the like. Accordingly, it is possible to improve image quality of the toner image. Moreover, this configuration also lowers the friction coefficient between the image bearing body and a member (cleaning blade, for example) that is press-contacted against the image bearing body. This is effectively suppresses wear (scraping) on the surface of the image bearing body, making it possible to extend a service life of the image bearing body.

The lubricant supplied by the lubricant supply mechanism and a lubricant layer (lubricant coating) formed by the lubricant are degraded by discharge products generated in the charging step, or the like. At the same time, the lubricant itself is also degraded by own deterioration. This kind of degradation sometimes causes an image flow due to reduced resistance of the lubricant layer, or abnormal wear of the cleaning member due to loss of lubricity (effect of reducing the frictional force) of the lubricant.

Moreover, the amount of lubricant existing on the image bearing body varies depending on a B/W ratio (black/white proportion) of an image pattern as a printing target, or depending on an installation environment of the image forming apparatus. The varying amount of lubricant applied sometimes causes an increase in the frictional force. This sometimes increases likelihood of wear of the cleaning member or lowers cleaning performance.

Therefore, a system employing a lubricant supply mechanism is required to provide a configuration to appropriately refresh lubricant, namely, a configuration to scrape (remove) old lubricant on the image bearing body and re-apply lubricant. Along with this, the system is required to provide a configuration to properly maintain the amount of applied lubricant on the image bearing body. Some known techniques employ a series of operation (hereinafter, also referred to as a "refresh mode") of removing degraded lubricant and supplying lubricant.

Execution time of the refresh mode is typically managed based on a predetermined time or the number of pulses, that can be predicted experimentally. For example, JP 2002-006689 A discloses an image forming apparatus that supplies lubricant to an image bearing body that forms a toner image so as to extend it service life and improve image quality. In a specific configuration, the image forming apparatus disclosed in JP 2002-006689 A, in order to remove discharge products on a photoreceptor, temporarily collects lubricant on the photoreceptor, so as to increase friction coefficient, and then, supplies lubricant. JP 2002-006689 A defines collecting lubricant from on the photoreceptor as a refresh mode, and the refresh mode is executed for a predetermined time.

Another known system has a configuration to supply lubricant by applying the lubricant. For example, JP 2005-181742 A disclose an image forming apparatus having a control means that, when it detects a photoreceptor unit as a new unit, performs application operation using a lubricant application means, measures a photoreceptor torque, and determines application operation time. In other words, JP 2005-181742 A discloses a configuration to apply lubricant while detecting a dynamic frictional force of the photoreceptor. Similarly, JP H08-305236 A discloses a configuration to detect changes in a pressure roller (charging roller and lubricant application roller) press-contacted against an image bearing body, such as a change in a rotation speed, operation torque, and an operation current value, using a detection means. With a detection signal, the configuration then controls, by using a control means, the amount of applied lubricant with a lubricant application means.

Unfortunately, however, if the refresh mode is executed under a predetermined condition after consecutively printing a large amount of materials based on an image pattern having a B/W ratio largely different from an ordinary B/W ratio of several %, or after an installation environment of the image forming apparatus has been changed, execution of the refresh mode might fails. In other words, executing the refresh mode for a predetermined limited and fixed period of time would turn out to be insufficient refreshed state due to insufficient removal of the lubricant, or overly refreshed state due to the excessive amount of collected lubricant. For example, in an environment with high temperature and high humidity, it is possible that a large amount of lubricant exists on an image bearing body, leading to insufficient cleaning.

Regarding these viewpoints, how the amount of applied lubricant can be optimized, or the like, is not taken into account in JP 2002-006689 A. Meanwhile, in JP 2005-181742 A and JP H08-305236 A, a situation in which a large amount of lubricant exists has not been taken into account.

SUMMARY OF THE INVENTION

Considering above, it is desired to provide a refresh mode capable of correcting excess and deficiency in the removing amount of degraded lubricant and in the supply amount of lubricant applied, and capable of optimizing the amount of lubricant existing on the image bearing body.

To achieve the abovementioned object, according to an aspect, an image forming apparatus reflecting one aspect of the present invention comprises: an image bearing body; a developing unit configured to develop an electrostatic latent image formed on the image bearing body as a toner image; a transfer unit configured to transfer the toner image to a receiver medium; a cleaning member configured to collect residual toner on the image bearing body after transfer; a lubricant supply unit configured to supply lubricant onto the image bearing body; a measurement unit configured to measure a static frictional force generated between the image bearing body and the cleaning member; and a control unit configured to be capable of executing correction processing of correcting the amount of lubricant on the image bearing body, wherein the control unit estimates a state of the lubricant on the image bearing body based on a change between a first static frictional force measured immediately after a start of the correction processing and a second static frictional force measured after processing of removing the lubricant on the image bearing body which has been executed after the measurement of the first static frictional force, and based on the estimated state of the lubricant, the control unit selectively executes one of processing from the options including processing of supplying lubricant onto the image bearing body and processing of removing lubricant on the image bearing body.

The control unit preferably repeats measurement of the static frictional force generated on the image bearing body, and the selective execution of the operation from the options including processing of supplying lubricant onto the image bearing body and processing of removing lubricant on the image bearing body until the static frictional force generated on the image bearing body falls within a predetermined range.

The control unit preferably measures a third static frictional force in a state where no lubricant exists on the image bearing body, then executes processing of supplying lubricant onto the image bearing body for a plurality of times, and after individual times of execution, measures a fourth static frictional force, determines a minimum value of the static frictional force based on the plurality of measured values of the fourth static frictional force, and determines a proper frictional force range based on the third static frictional force and the minimum value of the static frictional force.

The control unit preferably determines the minimum value of the static frictional force as a lower limit value of the proper frictional force range, and determines an upper limit value of the proper frictional force range by adding a value obtained by multiplying a predetermined coefficient with a difference between the third static frictional force and the minimum value of the static frictional force, to the minimum value of the static frictional force.

The measurement unit preferably measures a startup torque when the image bearing body is rotationally driven to be determined as the static frictional force, in a state where a cleaning blade configuring the cleaning member alone is press-contacted against the image bearing body.

The image forming apparatus preferably further includes a charging unit arranged along a surface of the image bearing body, at a portion from the developing unit to the cleaning member, and the control unit, by using the charging unit, preferably increases the amount of charge on toner that reaches the cleaning member compared with a case of usual image formation, and thus removes lubricant on the image bearing body.

The control unit, when removing lubricant on the image bearing body, preferably controls the lubricant supply unit so as to suppress supply of lubricant.

To achieve the abovementioned object, according to an aspect, an image forming method on an image forming apparatus, the image forming apparatus comprising: an image bearing body; a developing unit configured to develop an electrostatic latent image formed on the image bearing body as a toner image; a transfer unit configured to transfer the toner image to a receiver medium; a cleaning member configured to collect residual toner on the image bearing body after transfer; and a lubricant supply unit configured to supply lubricant onto the image bearing body, the image forming method reflecting one aspect of the present invention comprises: measuring a first static frictional force generated between the image bearing body and the cleaning member immediately after a start of correction processing configured to correct the amount of lubricant on the image bearing body; removing the lubricant on the image bearing body after measurement of the first static frictional force, and at the same time, measuring a second static frictional force generated between the image bearing body and the cleaning member; and estimating a state of the lubricant on the image bearing body based on a change between the first static frictional force and the second static frictional force, and based on the estimated state of the lubricant, executing one of processing selectively from the options including processing of supplying lubricant onto the image bearing body and processing of removing lubricant on the image bearing body.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described in detail with reference to the drawings. However, the scope of the invention is not limited to the illustrated examples. For same or corresponding portions in figures, same reference signs are attached and description will be omitted.

<A. Configuration of Image Forming Apparatus>

First, a configuration of an image forming apparatus 100 according to the present embodiment will be described. The image forming apparatus 100 described below as a typical example is a color image forming apparatus installed as a multi-functional peripheral (MFP). Note that a mechanism and method for removing degraded lubricant according to the present embodiment is also applicable to a monochromatic image forming apparatus. As a mechanism for forming a color image, a tandem type apparatus is described as an example. However, the mechanism is also applicable to a cycle type (typically four-cycle type) apparatus.

Figure 1:
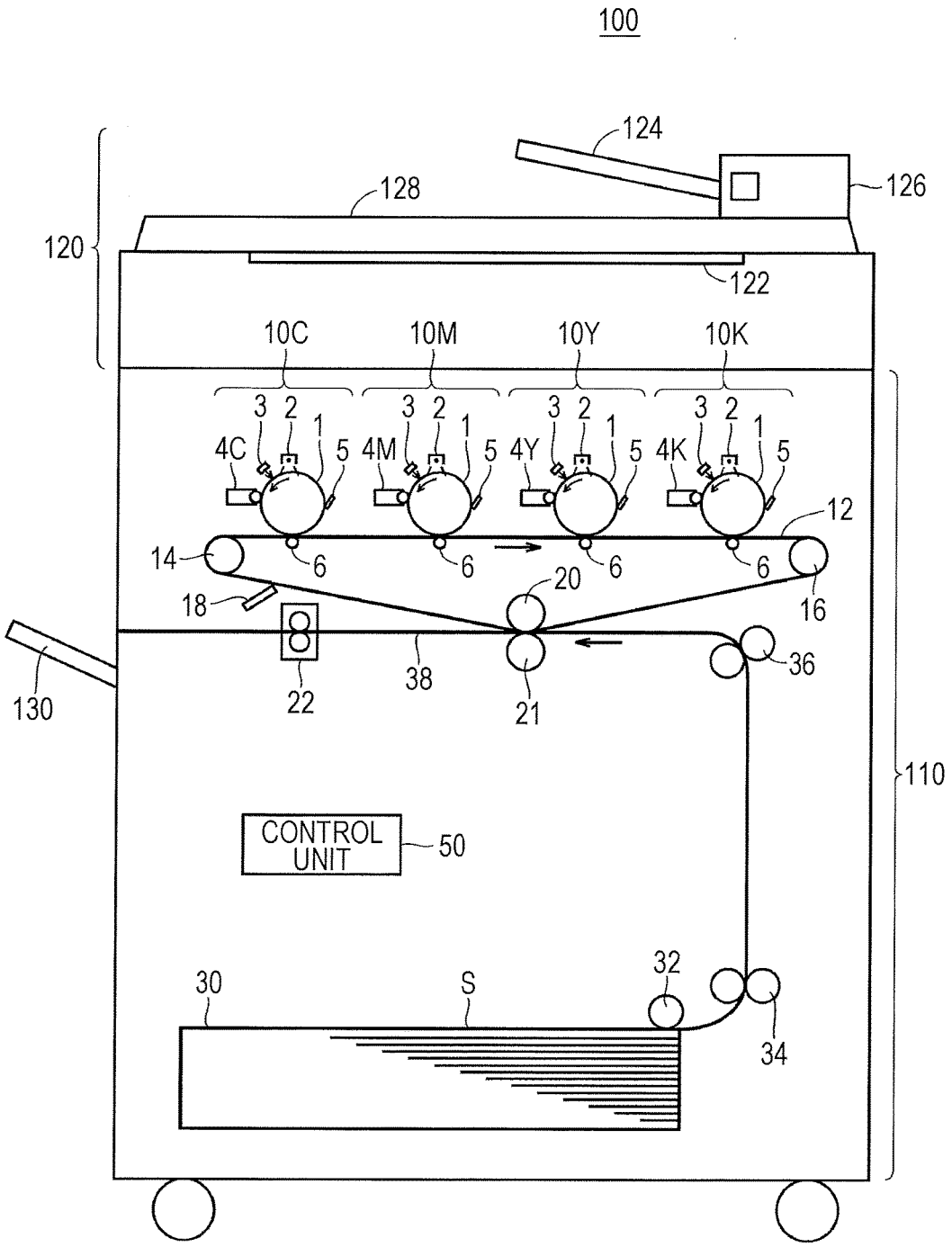
FIG. 1 is a general configuration diagram illustrating a cross-sectional structure of an image forming apparatus according to the present embodiment.

FIG. 1 is a general configuration diagram illustrating a cross-sectional structure of the image forming apparatus 100 according to the present embodiment. Referring to FIG. 1, the image forming apparatus 100 includes a print engine 110, a document read unit 120, and an output tray 130.

The print engine 110 executes an electrophotographic image forming process. The configuration illustrated in FIG. 1 is capable of executing full-color printout. A medium printed out is ejected to the output tray 130. Details of the print engine 110 will be described below.

The document read unit 120 reads a document and outputs a reading result, as an input image for the print engine 110. More specifically, the document read unit 120 includes an image scanner 122, a document feeding rack 124, a document auto-feeder 126, and a document discharging rack 128.

The image scanner 122 scans a document placed on platen glass. The image scanner 122 includes, as main components, a light source configured to emit light to a document, an image sensor configured to obtain an image generated by light that is emitted from the light source and reflected on the document, an analog to digital (AD) converter for outputting an image signal from the image sensor, and an imaging optical system arranged on a front stage of the image sensor.

The document auto-feeder 126 consecutively scans each of the documents placed on the document feeding rack 124. The document placed on the document feeding rack 124 is fed one by one by a delivery roller (not illustrated) and is then scanned by the image sensor arranged in the image scanner 122 or in the document auto-feeder 126. The document after being scanned is ejected to the document discharging rack 128.

The print engine 110 includes imaging units 10C, 10M, 10Y, and 10K (hereinafter, may be collectively referred to as an "imaging unit 10") for generating a toner image for each of cyan (C), magenta (M), yellow (Y), and black (K).

The image forming apparatus 100 according to the present embodiment employs, for example, a configuration in which the toner image generated by each of the imaging units 10 is transferred to a receiver member, namely, a medium S, via an intermediate transfer body. The image forming apparatus 100 includes, as the intermediate transfer body, an intermediate transfer belt 12 stretched by the intermediate transfer body driving rollers 14 and 16. The intermediate transfer belt 12 rotationally moves in a predetermined direction by rotational driving of the intermediate transfer body driving rollers 14 and 16. As the intermediate transfer body, it is possible to employ an intermediate transfer roller instead of the intermediate transfer belt illustrated in FIG. 1. FIG. 1 illustrates an exemplary configuration in which a toner image is once transferred to the intermediate transfer body and then, transferred to the medium S. Alternatively, it is allowable to transfer the toner image on the photoreceptor directly to the medium S.

Each of the imaging units 10C, 10M, 10Y, and 10K is arranged in this order along the intermediate transfer belt 12 that is rotationally driven while being stretched within the print engine 110. Each of the imaging units 10 includes a photoreceptor 1, a charging unit 2, an exposure unit 3, a developing unit 4 (to be described as 4C, 4M, 4Y, and 4K corresponding to a color of the toner image generated by the imaging unit 10), and a cleaning blade 5, and an intermediate transfer body contact roller 6.

The photoreceptor 1 is an image bearing body to bear the toner image. A photoreceptor roller, which may be used as the photoreceptor 1, has a photoreceptor layer on its surface. The photoreceptor 1 is arranged such that a toner image is formed on the photoreceptor surface and rotates in a direction that corresponds to a rotational direction of the intermediate transfer belt 12. As the image bearing body, a photoreceptor belt can be employed instead of the photoreceptor roller.

On the photoreceptor 1, an electrostatic latent image is formed by the exposure unit 3, and the electrostatic latent image is developed by the developing unit 4 so as to generate the toner image. In other words, the charging unit 2, the exposure unit 3, and the developing unit 4 form an electrostatic latent image and a toner image on the photoreceptor 1.

The charging unit 2 uniformly charges a surface of the photoreceptor 1. The exposure unit 3, using laser-beam writing, or the like, exposes a surface of the photoreceptor 1 according to a predetermined image pattern, thereby forming an electrostatic latent image on the surface of the photoreceptor 1. Typically, the exposure unit 3 includes a laser diode that emits a laser beam, and a polygon mirror for exposing the surface of the photoreceptor 1 with the laser beam in a main scanning direction.

The developing unit 4 develops the electrostatic latent image formed on the photoreceptor 1, namely, the image bearing body, as a toner image. As a typical example, the developing unit 4 develops an electrostatic latent image by using a two-component developer including toner and carrier. As a developing unit, a one-component developer (toner) can be used.

The toner image formed on a surface of the photoreceptor 1 is transferred to the intermediate transfer belt 12 by the intermediate transfer body contact roller 6. The intermediate transfer body contact roller 6 transfers the toner image developed on the photoreceptor 1 to the intermediate transfer belt 12, namely, a receiver medium. The photoreceptor 1 and the intermediate transfer belt 12 come in contact with each other at a portion where the intermediate transfer body contact roller 6 is disposed. It is configured such that a predetermined level of transfer bias is applied to the contact portion. With this transfer bias, the toner image on the photoreceptor 1 is transferred to the intermediate transfer belt 12.

On the intermediate transfer belt 12, a toner image from each of the photoreceptors 1 is sequentially transferred, so as to overlap four-color toner images with each other. The overlapped toner images are transferred from the intermediate transfer belt 12 to the medium S by transfer rollers 20 and 21. The print engine 110, as a configuration related to the transfer of the medium S, includes a paper feeding unit 30 that retains the medium S, a delivery roller 32, conveying rollers 34 and 36, and a fixing section 22. The delivery roller 32 sequentially delivers the medium S from the paper feeding unit 30 and is conveyed by the conveying rollers 34 and 36. By synchronizing the timing of delivery and conveyance of the medium S with a position on which toner images are overlapped on the intermediate transfer belt 12, it is possible to transfer the toner image onto a suitable position on the medium S. The medium S on which the toner image has been transferred is conveyed to reach the fixing section 22 along a conveyance path 38. The fixing section 22 executes fixing processing of the toner image. Thereafter, the medium S on which the toner image has been fixed is ejected to the output tray 130.

The print engine 110 includes a control unit 50 configured to perform overall control of the image forming apparatus 100. The control unit 50 includes, as main components, a processor such as a central processing unit (CPU), a volatile memory such as a dynamic random access memory (DRAM), a non-volatile memory such as a hard disk drive (HDD), and a various types of interfaces. Typically, in the print engine 110, a processor executes a various types of programs stored in the non-volatile memory. Accordingly, processing related to image formation on the image forming apparatus 100 is executed.

The control unit 50 is implemented when a processor executes a program. Alternatively, all or part of the processing may be implemented using dedicated hardware. When the processor executes a program, the program may be installed in a non-volatile memory via various types of recording media, or may be downloaded from a server apparatus (not illustrated) via a communication circuit.

<B. Typical Image Forming Process on Image Forming Apparatus>

Next, a typical image forming process executed in the image forming apparatus 100 illustrated in FIG. 1 will be described in an order of execution.

On each of the imaging units 10, a surface of the photoreceptor 1 is charged evenly by the charging unit 2. Thereafter, the photoreceptor 1 receives, from the exposure unit 3, laser scanning exposure in which light emission is controlled according to information of an input image. With this procedure, an electrostatic latent image is formed on a surface of the photoreceptor 1. A step (optical writing step) of forming an electrostatic latent image during scanning exposure by the exposure unit 3, while the photoreceptor 1 is being rotated, uses image information that is monochromatic image information. Each of the monochromatic image information has been obtained by dividing a predetermined input image (full-color image) into color information of each of cyan, magenta, yellow, and black. The control unit 50 controls laser beam emission and scanning according to each of the image information.

According to the monochromatic image information, an electrostatic latent image is formed on each of the photoreceptors 1. The electrostatic latent image is developed on each of the photoreceptors 1 by the developing units 4C, 4M, 4Y, and 4K, using each of monochromatic developers made of corresponding color of cyan, magenta, yellow, and black. And then, a toner image corresponding to each of the color information is formed. That is, a monochromatic toner image is formed on each of the photoreceptors 1, corresponding to each of the colors. Each of monochromatic toner images, using an action of a predetermined transfer bias, is synchronized with the corresponding photoreceptor 1, and then, is sequentially transferred onto the intermediate transfer belt 12 and overlapped with each other. Each of monochromatic toner images overlapped with each other on the intermediate transfer belt 12 is transferred all together to the medium S that has been conveyed from the paper feeding unit 30, by using the transfer rollers 20 and 21. At this time, a predetermined transfer bias is applied between the intermediate transfer belt 12 and the medium S. After the transfer of the toner image, the toner image on the medium S is fixed by the fixing section 22. This procedure completes forming a full-color image. The medium S on which the full-color image is formed is ejected to the output tray 130.

In a final step of the image forming process on the photoreceptor 1, cleaning is performed for transfer-residual toner on the photoreceptor 1 (residual toner after transfer of the toner image formed on a surface of the photoreceptor 1, to the intermediate transfer belt 12). For cleaning the surface of the photoreceptor 1, the cleaning blade 5 is provided, constantly being press-contacted against the photoreceptor 1. The cleaning blade 5 is a cleaning member for collecting toner remaining on the photoreceptor 1, namely, the image bearing body, after transfer of the toner image. The cleaning blade 5 is press-contacted against the photoreceptor 1 and scrapes transfer-residual toner from the surface of the photoreceptor 1.

In a similar manner, transfer-residual toner on the intermediate transfer belt 12 is also cleaned. To clean a surface of the intermediate transfer belt 12, the configuration includes a cleaning blade 18 that is press-contacted against the intermediate transfer belt 12. The cleaning blade 18 is a cleaning member for collecting the toner remaining on the intermediate transfer belt 12, namely, the image bearing body, after transfer of the toner image.

<C. Lubricant Supply Mechanism>

Figure 2:
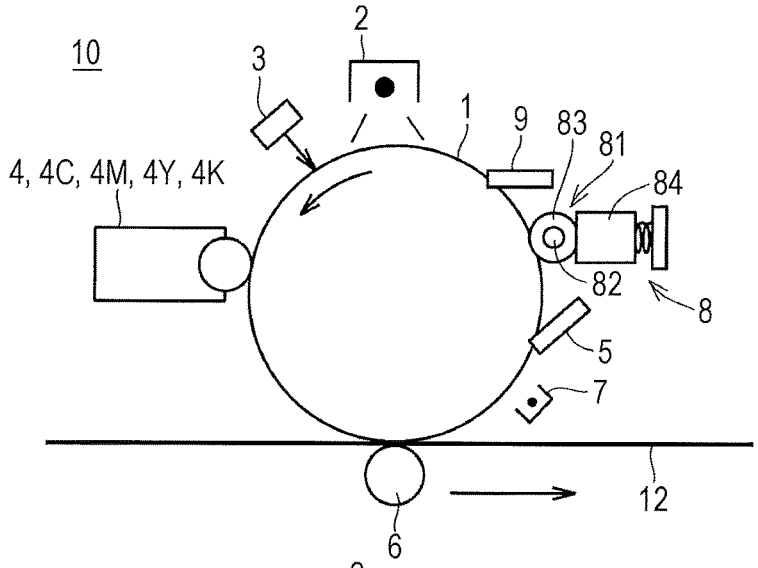
FIG. 2 is a schematic diagram illustrating an exemplary configuration of an imaging unit according to the present embodiment.
Figure 3:
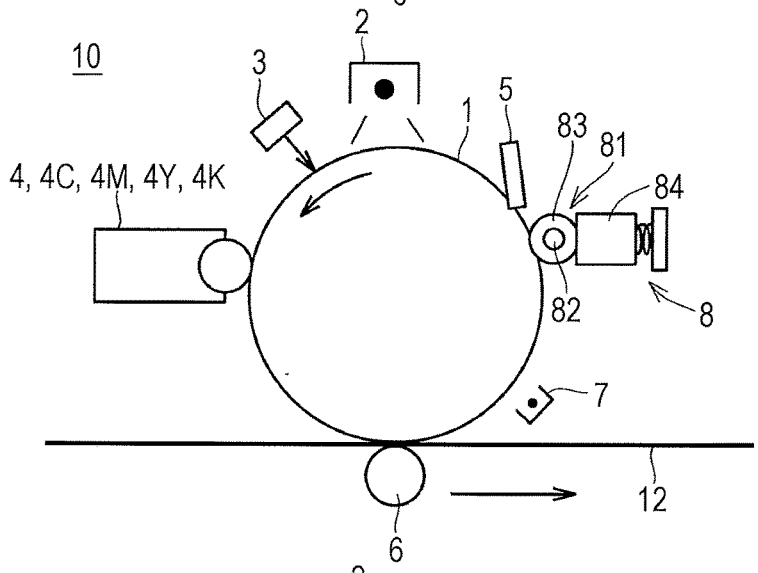
FIG. 3 is a schematic diagram illustrating another exemplary configuration of the imaging unit according to the present embodiment.
Figure 4:
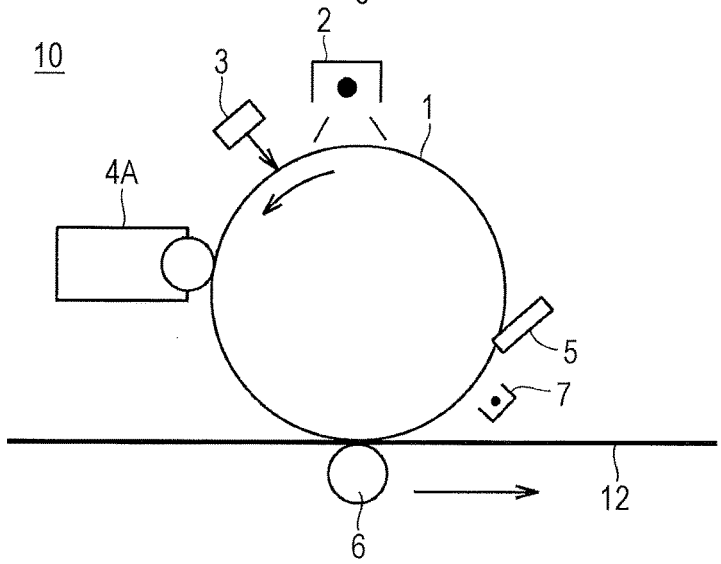
FIG. 4 is a schematic diagram illustrating yet another exemplary configuration of the imaging unit according to the present embodiment.

Next, a lubricant supply mechanism for supplying lubricant onto the photoreceptor 1, namely, the image bearing body will be described. FIGS. 2 to 4 illustrate exemplary configurations of surrounding components of the image bearing body. FIG. 2 is a schematic diagram illustrating an exemplary configuration of the imaging unit 10 according to the present embodiment. FIG. 3 is a schematic diagram illustrating another exemplary configuration of the imaging unit 10 according to the present embodiment. FIG. 4 is a schematic diagram illustrating yet another exemplary configuration of the imaging unit 10 according to the present embodiment.

The imaging unit 10 illustrated in FIG. 2 is configured to include, around the photoreceptor 1, the charging unit 2, the exposure unit 3, the developing unit 4, and the cleaning blade 5; and in addition to the above, a lubricant supply unit 8 and a leveling member 9, as the lubricant supply mechanism.

The lubricant supply unit 8 includes an application brush 81, which is press-contacted against the photoreceptor 1 and a solid lubricant 84. The application brush 81 rotates relative to the photoreceptor 1, thereby scraping the solid lubricant 84 so as to apply it to the photoreceptor 1. The leveling member 9 levels the lubricant supplied from the lubricant supply unit 8, thereby promoting formation of a lubricant layer on a surface of the photoreceptor 1.

The application brush 81 includes a shaft member 82 and a plurality of fiber brushes 83. The shaft member 82 extends in a width direction of the photoreceptor 1 (depth direction in FIG. 2). The plurality of fiber brushes 83 are arranged on an outer peripheral surface of the shaft member 82. For example, the application brush 81 is configured by winding around the shaft member 82 a base fabric on which a plurality of fiber brushes 83 are implanted, and fixing. A length of the base fabric is adjusted such that the fiber brushes 83 can come in contact with all areas of the photoreceptor 1 in the width direction. The shaft member 82 is mechanically coupled with a motor (not illustrated) and can be driven independently of the photoreceptor 1. Alternatively, it is possible to drive the shaft member 82 by coupling it to a driving section of another member, instead of providing a dedicated motor.

When the application brush 81 rotates, the solid lubricant 84 is scraped by the fiber brushes 83 of the application brush 81, and is adhered to the brush. Thereafter, the lubricant is applied to a surface of the photoreceptor 1. That is, with rotational driving of the application brush 81, the lubricant supply unit 8 functions as the lubricant supply mechanism.

FIG. 2 illustrates an exemplary configuration in which the lubricant supply unit 8 is arranged downstream of the cleaning blade 5. Alternatively, it may be arranged upstream of the cleaning blade 5. In an exemplary configuration illustrated in FIG. 3, by arranging the lubricant supply unit 8 upstream of the cleaning blade 5, the cleaning blade 5 performs a function of leveling the lubricant supplied from the lubricant supply unit 8, in addition to the function to clean the transfer-residual toner on the photoreceptor 1.

Alternatively, it is possible to configure such that the developing unit 4 provides a lubricant supply function. In an exemplary configuration illustrated in FIG. 4, it is configured that, by adding lubricant into the toner supplied by the developing unit 4, the lubricant is supplied to the photoreceptor 1. That is, in the exemplary configuration illustrated in FIG. 4, the developing unit 4 provides a function as a lubricant supply unit.

Furthermore, configurations illustrated in FIGS. 2 to 4 may be combined appropriately.

Operation and a function of the secondary charging unit 7 illustrated in FIGS. 2 to 4 will be described below.

<D. Lubricant>

The image forming apparatus 100 according to the present embodiment uses a metal soap such as metal stearate as solid lubricant. Specifically, zinc stearate is used among the metal stearate.

As the solid lubricant, dry solid hydrophobic lubricant can be applied. As the dry solid hydrophobic lubricant, it is possible to use relatively high-order fatty acid metal salt (metal soap) including, as typical examples, metal stearate such as zinc stearate, barium stearate, lead stearate, iron stearate, nickel stearate, cobalt stearate, copper stearate, strontium stearate, calcium stearate, cadmium stearate, magnesium stearate. Other typical examples include: zinc oleate, manganese oleate, iron oleate, cobalt oleate, lead oleate, magnesium oleate, copper oleate, palmitic acid, zinc palmitate, cobalt palmitate, copper palmitate, magnesium palmitate, aluminum palmitate, calcium palmitate, lead caprylate, lead caproate, zinc linoleate, cobalt linoleate, calcium linoleate, and cadmium ricolinoleate. Among these, particularly preferable one is metal stearate in which stearic acid and metal salt are combined. It is also possible to use a natural wax such as carnauba wax.

<E. Outline of Problem and Solution>

It is required to execute refreshing operation for the photoreceptor 1, namely, the image bearing body. In this context, the refreshing operation includes removing degraded lubricant on the photoreceptor 1, and supplying lubricant to the photoreceptor 1. The refreshing operation is required to be executed in a proper degree corresponding to a state of lubricant in each of execution timing. In related art, however, detection of a state of lubricant has not been discussed, and there has been no known technical concept of using various refreshing operation (using different amount of collection of lubricant, or amount of application of lubricant) corresponding to the state of the lubricant.

The present inventors have reached the above-described new problems and ideas, and after intensive studies, have found that the value of the static frictional force generated between the photoreceptor 1 (image bearing body) and the cleaning blade 5 is lower in a state where the proper amount of lubricant is applied to the photoreceptor 1, than in any state other than this.

Figure 5:
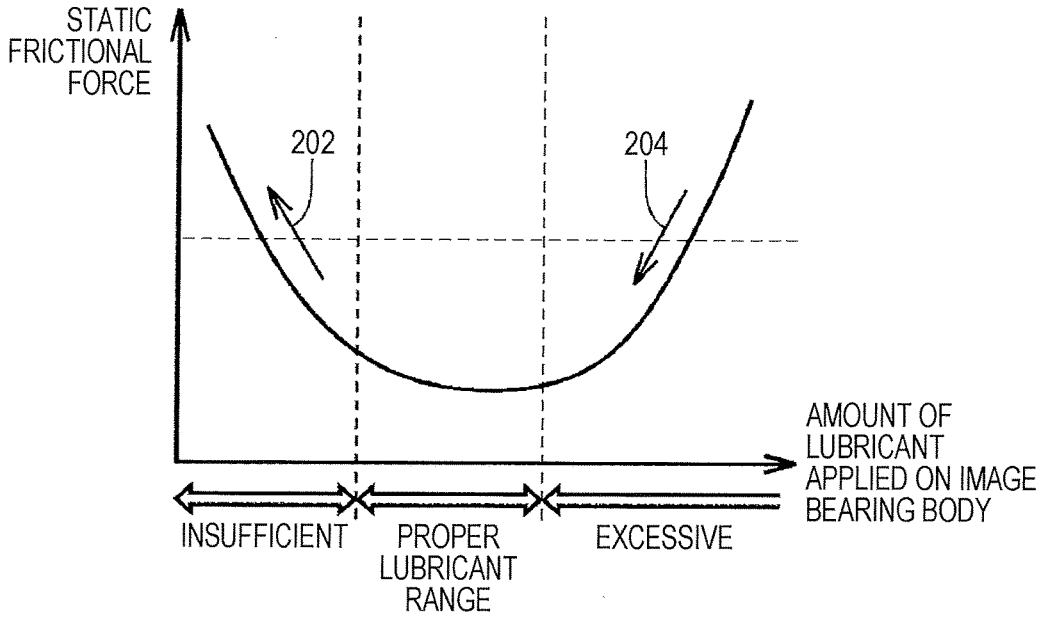
FIG. 5 is a schematic diagram illustrating a property of a static frictional force generated on the imaging unit according to the present embodiment.

FIG. 5 is a schematic diagram illustrating a property of the static frictional force generated on the imaging unit 10 according to the present embodiment. As illustrated in FIG. 5, it has been found that when a static frictional force occurring between the photoreceptor 1 and the cleaning blade 5 is at its minimum value or around the minimum value, the amount of applied lubricant on the photoreceptor 1 is within a proper lubricant range. The image forming apparatus 100 according to the present embodiment implements proper execution of a refresh mode using this static frictional force property.

According to the findings illustrated in FIG. 5, in order to adjust the amount of applied lubricant to a proper level, it is merely required to execute the refresh mode such that the static frictional force generated between the photoreceptor 1 and the cleaning blade 5 is lowered. However, measuring the static frictional force alone cannot be useful for determining whether the lubricant is degraded or the amount of lubricant on the photoreceptor 1 is excessive or insufficient. In other words, with measurement value of the static frictional force at one time point alone, it is not possible to take measures to maintain the amount of applied lubricant within a proper range.

Typically, the amount of application of lubricant and the torque caused by a frictional force on a surface of the photoreceptor 1 have a relationship of quadratic function. If the lubricant is degraded, the measured torque deviates from a quadratic curve. However, it is difficult to determine whether the amount of application of lubricant is excessive or insufficient, or the lubricant is degraded by measuring the torque alone.

The present inventors, after further intensive studies, have achieved another finding that, by measuring a plurality of values of the static frictional force, and based on the measured static frictional force values, it is possible to determine whether the amount of applied lubricant is excessive or insufficient.

More specifically, when the static frictional force measured at certain timing is higher than a proper value, lubricant on the photoreceptor 1 is removed, and then, the static frictional force after removal of the lubricant is measured. Evaluation of how the static frictional force has changed between before and after the removal of lubricant is performed. If the static frictional force has increased (as indicated with a direction of a sign 202 in FIG. 5), it is possible to determine that lubricant is insufficient (in an insufficient range), and that it is required to apply lubricant onto the photoreceptor 1. On the other hand, if the static frictional force has decreased (as indicated with a direction of a sign 204 in FIG. 5), it is possible to determine that lubricant is excessive (in a range of excessive range), and that it is required to further remove lubricant on the photoreceptor 1.

With this repetition of application and removal of the lubricant to/from the photoreceptor 1 based on a sequential determination using a change in the static frictional force, it is possible to maintain the amount of applied lubricant on the photoreceptor 1 within a proper range. As illustrated in FIG. 5, the static frictional force has a concave (downwardly convex) property with respect to the amount of applied lubricant. Accordingly, when the amount of application of lubricant is insufficient, the static frictional force is monotonously decreased. On the other hand, when the amount of applied lubricant is excessive, the static frictional force is monotonously increased. Accordingly, using the relationship between increase/decrease in t the amount of applied lubricant and increase/decrease of static frictional force, it is possible to adjust the amount of applied lubricant to a proper level.

As described above, the image forming apparatus 100 according to the present embodiment includes the refresh mode capable of correcting excess and deficiency in the removing amount of degraded lubricant and in the supply amount of lubricant applied, and capable of optimizing the amount of lubricant existing on the photoreceptor 1. That is, the refresh mode according to the present embodiment corresponds to correction processing for correcting the amount of lubricant on the photoreceptor 1 (image bearing body). The refresh mode is typically executed by the control unit 50.

<F. Outline of Refresh Mode>

Next, an outline of the refresh mode installed in the image forming apparatus 100 according to the present embodiment will be described.

A lubricant layer (lubricant coating) formed on the photoreceptor 1 is degraded by discharge products generated in a charging step, or the like. At the same time, the lubricant itself is also degraded by own deterioration. Moreover, after consecutively printing a large amount of materials based on an image pattern having a B/W ratio largely different from an ordinary B/W ratio of several %, or after installation environment of the image forming apparatus 100 has been changed, the amount of applied lubricant tends to vary.

In order to suppress an increase of image flow (image blur) and blade wear caused by disturbance on the lubricant layer, it is required to remove degraded lubricant coating on the photoreceptor 1, or to cope with a variation of the amount of applied lubricant by correcting excess or deficiency of the amount of applied lubricant on the photoreceptor 1 so as to maintain the proper amount of application of lubricant.

As described above, it has been found that in a state where the proper amount of non-degraded lubricant is applied to the photoreceptor 1, the static frictional force is in the vicinity of a range to indicate its minimum value. Accordingly, it is required to decrease the static frictional force to a level in the vicinity of the minimum value in the refresh mode. It is, however, difficult to determine whether the rise of static frictional force is caused by degradation of the lubricant or caused by excessive or insufficient amount of lubricant on the photoreceptor 1, just by measuring the static frictional force.

Therefore, in the refresh mode according to the present embodiment, the control unit 50 estimates a state of the lubricant on the photoreceptor 1, based on a change found between a first static frictional force measured immediately after a start of the refresh mode, and a second static frictional force measured after processing of removing the lubricant on the photoreceptor 1, executed after the measurement of the first static frictional force. Then, based on the estimated state of the lubricant, the control unit 50 executes one of processing selectively from the options including processing of supplying lubricant onto the photoreceptor 1 and processing of removing lubricant on the photoreceptor 1. In addition, corresponding to a condition, the control unit 50 repeats measuring the static frictional force generated on the photoreceptor 1, and the selective execution of the operation from the options including processing of supplying lubricant onto the photoreceptor 1 and processing of removing lubricant on the photoreceptor 1 until the static frictional force generated on the photoreceptor 1 falls within a predetermined range. With a series of processing as above, the amount of lubricant on the photoreceptor 1 is corrected to a proper range.

More specifically, at first, the static frictional force is measured, and when its value is within a proper lubricant range, the refresh mode is finished. If the value is not within the proper lubricant range, operation of removing the lubricant is executed, and the static frictional force after the removal operation is measured. Then, values of the static frictional force are compared between before and after the operation. If the static frictional force after the operation has increased, it is determined that the lubricant is insufficient, and operation of applying lubricant onto the photoreceptor 1 is executed. On the other hand, when the static frictional force after the operation is lowered, it is determined that the lubricant is excessive, and operation of removing lubricant on the photoreceptor 1 is executed. A change in the values of the static frictional force before and after application of lubricant is measured and based on a result of the change, operation of removing or applying the lubricant on the photoreceptor 1 is repeated. Then, when the static frictional force falls into a proper lubricant range, the refresh mode is finished.

Operation of removing or applying lubricant in the refresh mode is finished in approximately one to two seconds per operation. Thus, the refresh mode is finished as a whole in relatively a short time.

<G. Measuring Static Frictional Force and Estimating Static Frictional Force Property (Initial Setup)>

Next, a method for measuring the static frictional force and a method for estimating a static frictional force property as illustrated in FIG. 5, by using the measurement method, will be described.

The image forming apparatus 100 according to the present embodiment includes a measurement function to measure the static frictional force generated between the photoreceptor 1 (image bearing body) and the cleaning blade 5. Methods for measuring the static frictional force typically include a method of performing an indirect measurement using a frictional force measurement device, and a method of performing a direct measurement by using a current value of a motor used for rotational driving of the photoreceptor 1.

In the former method, the measurement is performed by contacting the frictional force measurement device with the photoreceptor 1 to obtain a static friction coefficient of the photoreceptor 1. A value that is output from the frictional force measurement device is the static friction coefficient of the photoreceptor 1; however, when a physical property of the cleaning blade 5 is known, it is possible to convert using a value of the physical property to calculate a value indicating the static frictional force generated between the photoreceptor 1 and the cleaning blade 5.

When the latter method is used, on the other hand, by employing, for example a DC motor used for rotationally driving of the photoreceptor 1, and measuring a value of a current that flows in the DC motor, it is possible from the measurement value to calculate a static torque that indicates the level of the static frictional force. In this measurement method, having a configuration in which units including the developing unit 4, the intermediate transfer body contact roller 6 (transfer member), the lubricant supply unit 8 (lubricant application member), and the lubricant supply unit 8 (for all of these, refer to FIGS. 2 to 4) are arranged to be spaced from the photoreceptor 1, and the cleaning blade 5 alone is press-contacted against the photoreceptor 1, it is possible to measure the static frictional force (static torque) with higher precision.

As described above, on the imaging unit 10, the static frictional force property as illustrated in FIG. 5 is found between the photoreceptor 1 and the cleaning blade 5. However, in practice, the image forming apparatus 100 has individual difference. It is true that, in each of the apparatuses, it is preferable that the static frictional force is at a minimum value or in the vicinity of the minimum value, but the minimum value that is proper to each of the apparatuses differs from each other. Accordingly, at a time of initial setup of the image forming apparatus 100, it is configured to estimate the static frictional force property generated on the imaging unit 10. The initial setup is executed after installation of each of the image forming apparatuses 100 has been completed. This timing is determined as above because it is required to adjust various types of parameters depending on an installation environment of each of the image forming apparatuses 100. Note that the initial setup also includes various types of setting processing in addition to processing of estimating the static frictional force property (minimum frictional force) described herein.

Figure 6:
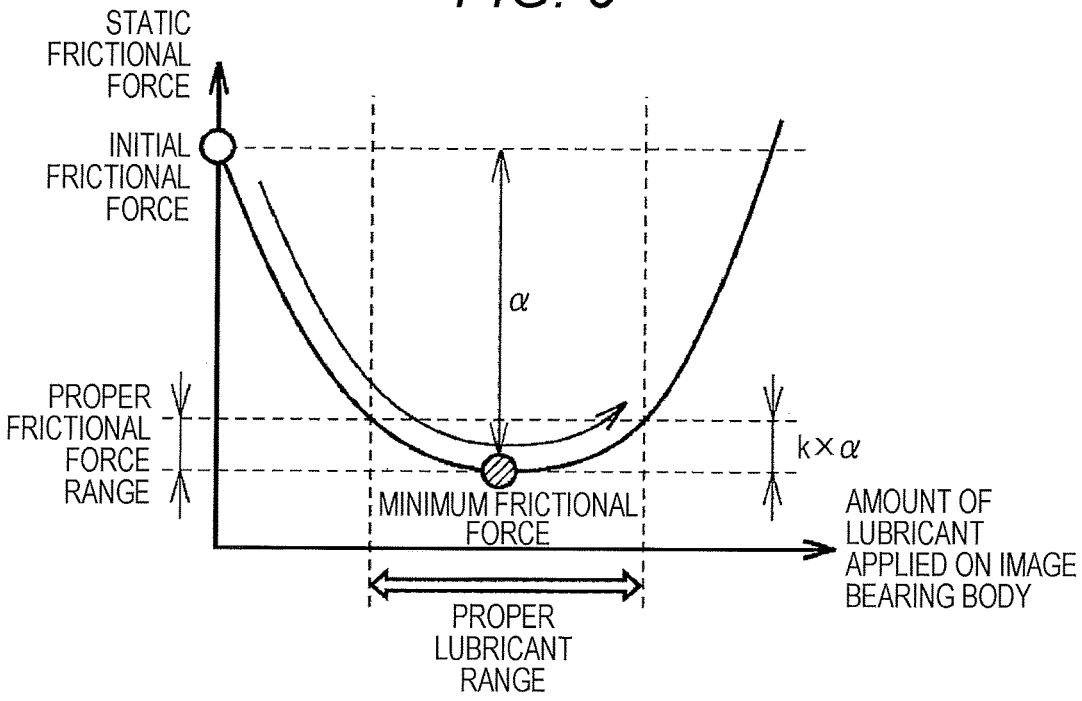
FIG. 6 is a schematic diagram illustrating estimating processing of a static frictional force property, executed at initial setup on the image forming apparatus according to the present embodiment.

FIG. 6 is a schematic diagram illustrating estimation processing of the static frictional force property executed at the time of initial setup on the image forming apparatus 100 according to the present embodiment. Referring to FIG. 6, the static frictional force when no lubricant exists on the photoreceptor 1 is relatively great, but the static frictional force decreases when application of lubricant begins, depending on the lubricant applied to the surface of the photoreceptor 1. To a certain degree, the more the amount of applied lubricant, the less the static frictional force. However, when the amount of applied lubricant is excessive, the static frictional force begins to increase. When the static frictional force is greater, the cleaning blade 5 is more likely to wear. Thus, considering endurance of the cleaning blade 5, it is required to maintain the static frictional force at a level of its minimum value or in the vicinity of the minimum value level. That is, it is required to adjust the amount of applied lubricant to a level at the minimum value of the static frictional force or in the vicinity of the minimum value level.

In practice, each of the apparatuses has its own minimum value of the static frictional force, and a value of the static frictional force before application of lubricant (initial state) in each of the apparatuses differs from each other. Accordingly, it is configured such that the control unit 50 of the image forming apparatus 100 according to the present embodiment measures a third static frictional force in a state where no lubricant exists on the photoreceptor 1. The control unit 50 then executes processing of supplying lubricant onto the photoreceptor 1 for a plurality of times. After individual times of execution, the control unit 50 measures a fourth static frictional force, determines a minimum value of the static frictional force based on the plurality of measured values of the fourth static frictional force, and determines a proper frictional force range based on the third static frictional force and the minimum value of the static frictional force.

More specifically, application of lubricant and measurement of the static frictional force are repeated to determine the minimum frictional force. As illustrated in FIG. 6, when application of lubricant starts sooner, namely from an initial state, the static frictional force decreases. If the static frictional force increases in the lubricant application operation, it is determined that the amount of applied lubricant is excessive and the application operation is discontinued. In the series of operation, the measured minimum value of the static frictional force is stored as the minimum frictional force of the image forming apparatus 100.

Figure 7:
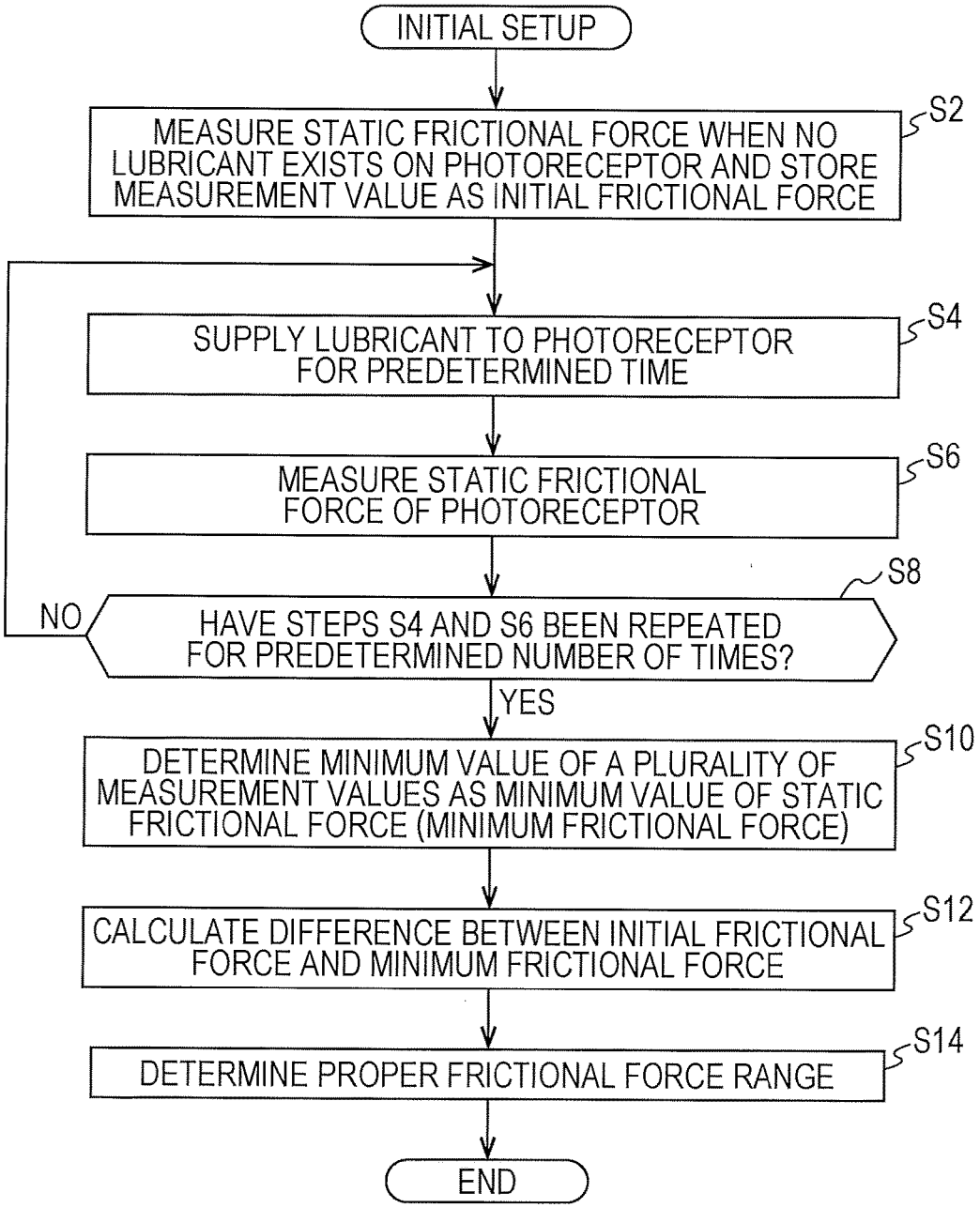
FIG. 7 is a flowchart illustrating a processing procedure for the estimating processing of the static frictional force property, executed at initial setup on the image forming apparatus according to the present embodiment.

FIG. 7 is a flowchart illustrating a processing procedure of estimating processing of the static frictional force property, executed at the time of initial setup on the image forming apparatus 100 according to the present embodiment. Each of steps illustrated in FIG. 7 is typically executed when the control unit 50 executes a previously installed program. The estimating processing of the static frictional force property illustrated in FIG. 7 is typically executed once after installation of the image forming apparatus 100. It may, however, be configured to execute this estimation processing periodically considering that the static frictional force property might change from an initial property due to a change over time or a change in an installation environment.

Referring to FIG. 7, the control unit 50 of the image forming apparatus 100 measures the static frictional force when no lubricant exists on the photoreceptor 1, and stores a measurement value as an initial frictional force (step S2). Subsequently, the control unit 50 supplies lubricant onto the photoreceptor 1 for a predetermined time (step S4), thereafter, measures the static frictional force of the photoreceptor 1 and then stores a measurement value (step S6). This lubricant supply operation as above is repeated for a plurality of times. In other words, the control unit 50 determines whether steps S4 and S6 have been repeated for a predetermined number of times (step S8), if it has been repeated for the predetermined number of times (YES in step S8), determines the minimum value of a plurality of measurement values stored by the plurality of times of execution of step S6 as a minimum value of the static frictional force (minimum frictional force) and stores the value (step S10). Alternatively, it is possible, in determination processing of step S8, to configure to finish repetitive processing when a static frictional force measurement value has shifted from a decreasing direction to an increasing direction, instead of repeating the processing for a predetermined number of times.

Subsequently, the control unit 50 calculates a difference $\alpha$ between the initial frictional force and the minimum frictional force (step S12), and then, determines a range beginning from the minimum frictional force value to a value that is obtained by adding a product of the static frictional force difference α and a coefficient k, to the minimum frictional force, as a proper frictional force range (step S14). This proper frictional force range is determined as a target range of the amount of applied lubricant. In other words, the control unit 50 determines the minimum of the static frictional force as a lower limit of the proper frictional force range. At the same time, the control unit 50 first multiplies the difference between the initial frictional force (third frictional force) and the minimum frictional force (minimum value of the static frictional force) with a predetermined coefficient, then adds this multiplied value to the minimum static frictional force value. The control unit 50 determines the value obtained by this addition as an upper limit value of the proper frictional force range.

It is preferable that the coefficient k is approximately 0.1 (10%) based on findings by the present inventors. Processing of calculating the proper frictional force range is processing for compensating for the individual difference among the image forming apparatuses 100. This finishes the estimation processing of the static frictional force property.

The processing procedure illustrated in FIG. 7 is an example in which the minimum value is determined among a plurality of measurement values. Alternatively, it is possible to estimate the minimum value using functional fitting. In this case, it is configured to first prepare a function that includes a plurality of coefficients, and these coefficients are fit into a function using the measurement value to determine a function to indicate the static frictional force property. Thereafter, a minimum frictional force is uniquely calculated from the determined function. In this case, it is preferable that setting of the functions is performed for each apparatus model.

<H. Proper Frictional Force Range and Proper Lubricant Range>

Next, technical significance of the proper frictional force range and the proper lubricant range will be described.

In the imaging unit 10, when a startup torque at a time of starting the rotational driving of the photoreceptor 1 is great, wear of the cleaning blade 5 rapidly progresses. Meanwhile, the cleaning blade 5 typically scrapes toner using a reciprocal movement of a stick slip. During this, if stick operation to cause the static frictional force (having high correlation with the startup torque) and a dynamic friction torque are excessive, the cleaning blade 5 rapidly wears, and this is not preferable considering endurance of the image forming apparatus 100.

To cope with this, a configuration is used in which the startup torque is controlled to be as close to the minimum value as possible, so as to provide a robust system that is robust in coping with wear of the cleaning blade 5. The amount of applied lubricant for which the startup torque is considered to be applicable in the vicinity of the minimum value is determined as the proper lubricant range.

As described above, a range in the vicinity of the minimum value of the startup torque is a range from the minimum frictional force to the value that is obtained by adding a product of the static frictional force difference cc and a coefficient k, to the minimum frictional force. This range is determined to be a target range (proper frictional force range) used for correcting excess or deficiency of the amount of applied lubricant. After intensive studies of the present inventors, it is found out that it is preferable to set the coefficient k to approximately 10%.

Moreover, the present inventors have found that the startup torque has a relationship of a quadratic function with the amount of applied lubricant. This means excessive or insufficient amount of lubricant applied would increase the startup torque and it would not be a preferable situation. To cope with this, it is configured to execute a refresh mode in a procedure described below, in order to maintain the amount of applied lubricant within the proper lubricant range.

In addition, the startup torque increases along with degradation of lubricant, even when the amount of applied lubricant is within the proper lubricant range. The degradation of lubricant will be described below.

<I. Processing Procedure of the Refresh Mode>

Figure 8:
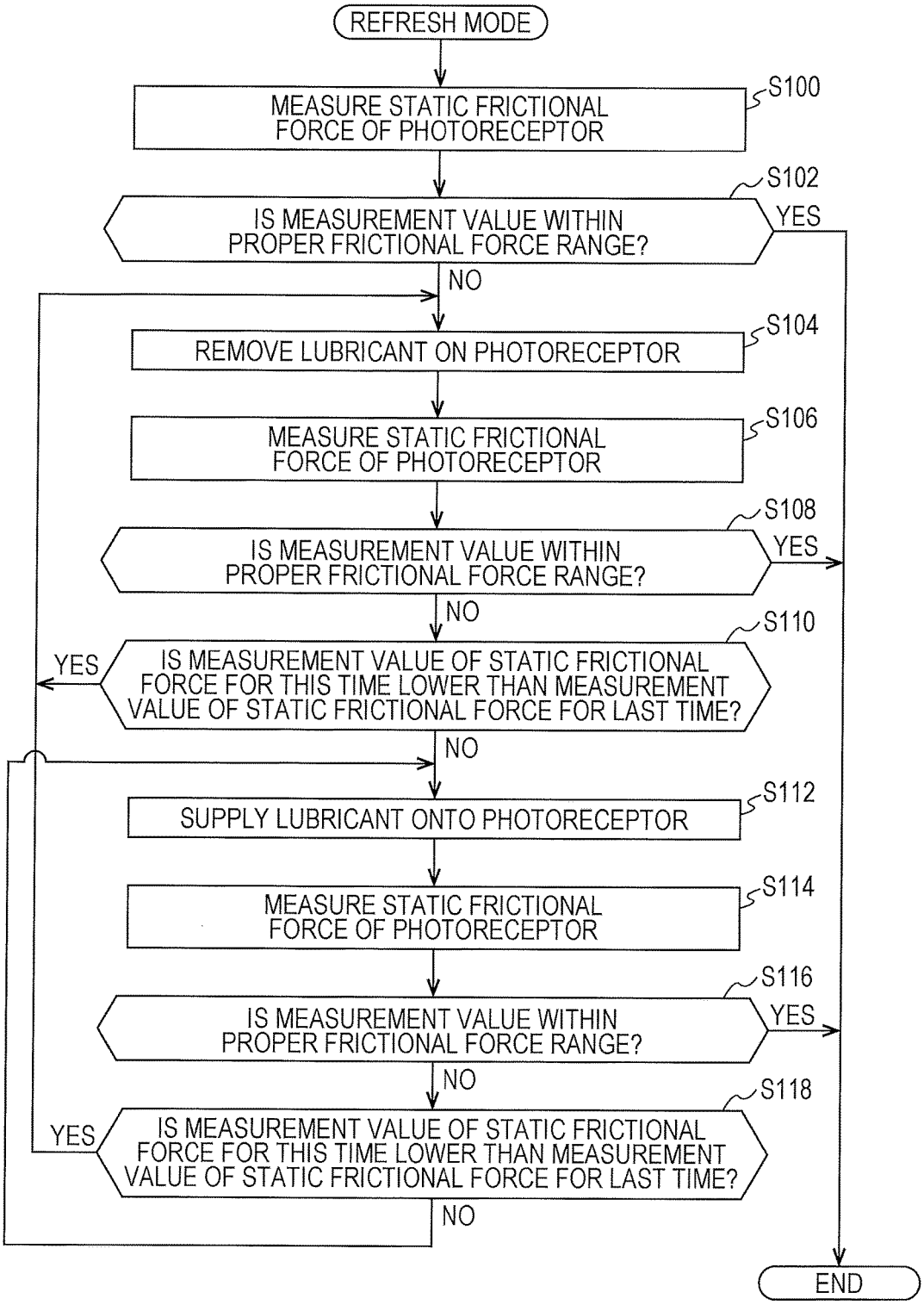
FIG. 8 is a flowchart illustrating a processing procedure of a refresh mode executed on the image forming apparatus according to the present embodiment.

Next, processing procedure of the refresh mode according to the present embodiment will be described. FIG. 8 is a flowchart illustrating a processing procedure of the refresh mode executed on the image forming apparatus 100 according to the present embodiment. Each of steps illustrated in FIG. 8 is typically executed when the control unit 50 executes a previously installed program. It is preferable that the refresh mode illustrated in FIG. 8 is executed separately from usual image forming processing.

Prior to execution of the refresh mode illustrated in FIG. 8, the static frictional force property has been estimated by the above-described initial setup. The refresh mode illustrated in FIG. 8 is started when a certain starting condition is satisfied.

Referring to FIG. 8, the control unit 50 of the image forming apparatus 100 measures a static frictional force of the photoreceptor 1 (step S100), and determines whether the measurement value is within a proper frictional force range (step S102). The obtained measurement value of the static frictional force of the photoreceptor 1 is temporarily stored. That is, the control unit 50 measures the first static frictional force between the photoreceptor 1 (image bearing body) and the cleaning blade 5 (cleaning member) generated immediately after the start of the refresh mode (correction processing).

It is preferable that measurement of the static frictional force is performed in a state where the cleaning blade 5 alone is press-contacted against the photoreceptor 1. In other words, it is preferable that the measurement function of measuring the static frictional force is configured to measure a startup torque when the photoreceptor 1 is rotationally driven, and determine the value as the static frictional force, in a state where the cleaning blade 5 configuring the cleaning member alone is press-contacted against the photoreceptor 1.

Furthermore, in order to achieve higher precision in measuring the static frictional force of the cleaning blade 5, it is preferable to remove residual substances such as toner, external additive, and lubricant on the cleaning blade 5. To remove these, the photoreceptor 1 is rotated for a several to 20 mm, in a direction opposite to a usual rotational direction. This rotation facilitates removing the residual substances on the cleaning blade 5. In addition, it is preferable that the static frictional force is calculated based on the measurement value of the torque at startup.

When the measurement value is within the proper frictional force range (YES in step S102), it is determined that the amount of applied lubricant on the photoreceptor 1 is proper; thus, the refresh mode finishes.

On the contrary, when the measurement value is out of the proper frictional force range (NO in step S102), the control unit 50 removes the lubricant on the photoreceptor 1 (step S104).

The control unit 50 of the image forming apparatus 100 measures the static frictional force of the photoreceptor 1

(step S106), and determines whether the measurement value is within the proper frictional force range (step S108). The obtained measurement value of the static frictional force of the photoreceptor 1 is temporarily stored. That is, the control unit 50 measures the first static frictional force, and thereafter, removes the lubricant on the photoreceptor 1, and then, measures the second static frictional force generated between the photoreceptor 1 and the cleaning blade 5.

When the measurement value is within the proper frictional force range (YES in step S108), it is determined that the amount of applied lubricant on the photoreceptor 1 falls within a proper range; thus, the refresh mode finishes.

On the contrary, when the measurement value is out of the proper frictional force range (NO in step S108), the control unit 50 determines whether the measurement value of the static frictional force for this time is lower than the measurement value of the static frictional force for the last time (step S110).

If the measurement value of the static frictional force for this time is smaller than the measurement value of the static frictional force for the last time (YES in step S110), it means that the static frictional force has decreased with removal of the lubricant. Based on this, it is possible to determine that the current amount of applied lubricant on the photoreceptor 1 is excessive. In this case, the control unit 50 further removes the lubricant on the photoreceptor 1 (step S104). Then, execution of processing after step S104 is executed again.

If the measurement value of the static frictional force for this time is greater than the static frictional force for the last time (NO in step S110), it means that the static frictional force has increased with removal of the lubricant. Based on this, it is possible determine that the current amount of applied lubricant on the photoreceptor 1 is insufficient. In this case, the control unit 50 supplies lubricant onto the photoreceptor 1 (step S112).

The control unit 50 of the image forming apparatus 100 further measures the static frictional force of the photoreceptor 1 (step S114), and determines whether the measurement value is within the proper frictional force range (step S116). The obtained measurement value of the static frictional force of the photoreceptor 1 is temporarily stored. When the measurement value is within the proper frictional force range (YES in step S116), it means that the amount of applied lubricant on the photoreceptor 1 falls within a proper range; thus, the refresh mode finishes.

On the contrary, when the measurement value is out of the proper frictional force range (NO in step S116), the control unit 50 determines whether the measurement value of the static frictional force for this time is lower than the measurement value of the static frictional force for the last time (step S118).

If the measurement value of the static frictional force for this time is lower than the measurement value of the static frictional force for the last time (YES in step S118), it means that the static frictional force has been decreased when the lubricant has been removed. From this, it is possible to determine that the current amount of applied lubricant on the photoreceptor 1 is excessive. In this case, the control unit 50 further removes the lubricant on the photoreceptor 1 (step S104). Then, execution of processing after step S104 is executed again.

In comparison, if the measurement value of the static frictional force for this time is greater than the static frictional force for the last time (NO in step S118), it means that the static frictional force has increased with removal of the lubricant. From this, it is possible determine that the current amount of applied lubricant on the photoreceptor 1 is insufficient. In this case, the control unit 50 further supplies lubricant onto the photoreceptor 1 (step S112).

In the above-described steps S110 and S118, the control unit 50 of the image forming apparatus 100 estimates a state of the lubricant on the photoreceptor 1 based on a change between the first static frictional force and the second static frictional force. In addition, based on the estimated state of the lubricant, the control unit 50 executes one of processing selectively from the options including processing of supplying lubricant onto the photoreceptor 1 and processing of removing lubricant on the photoreceptor 1.

With a processing procedure described above, the amount of applied lubricant on the photoreceptor 1 is optimized. In FIG. 8, an exemplary simplified processing procedure that has not considered an image pattern that is a target for image formation. Alternatively, it is possible to configure such that processing and execution timing may be controlled in consideration of the image pattern.

<J. Starting Condition for the Refresh Mode>

It is possible to configure such that the above-described refresh mode is executed when various types of starting conditions are satisfied.

(j1: Number of Sheets to Print)

For example, it is possible to employ a starting condition related to the number of sheets to print. More specifically, it is preferable to configure such that the refresh mode is executed each time a predetermined number of sheets are printed. That is, starting conditions of the refresh mode include a condition that, in usual image forming, the number of times of forming a toner image on the photoreceptor 1 reaches a predetermined value. By repeating execution of the refresh mode each time a predetermined number of sheets is printed, it is possible to achieve image forming with long-term stability. Moreover, it is possible to execute the refresh mode as part of processing (start sequence) to be executed at the time of power-on (or returning from power-saving mode) of the image forming apparatus 100. Alternatively, it is possible to execute the refresh mode as part of processing (end sequence) to be executed at the time of power-off (or switching to the power-saving mode) of the image forming apparatus 100.

(j2: Identical Image Pattern)

After consecutive image forming operation that corresponds to an image pattern with a small B/W ratio, the amount of toner supplied to the cleaning blade 5 significantly decreases. Accordingly, there are very few opportunities to effectively use the function to remove degraded lubricant. In this case, for portions corresponding to a non-image portion (white portion on which toner is not adhered in image forming) in particular, degraded lubricant is not removed and but is going to be accumulated. If accumulation of degraded lubricant becomes noticeable, it is likely to cause associated problems. In other words, in a case where an identical image pattern is consecutively printed, degradation of lubricant in the non-image portion is likely to be noticeable and this is likely to cause associated problems.

In consideration of this finding, it is preferable that the starting conditions for the refresh mode according to the present embodiment include the number of printed sheets on which an identical image pattern is consecutively printed. That is, starting conditions for the refresh mode include a condition in which an identical image pattern is consecutively formed for a predetermined number of times, in usual image forming operation.

<K. Lubricant Removal Function>

Next, a function of removing lubricant on the photoreceptor 1 of the image forming apparatus 100 (step S104 in FIG. 8) will be described.

(k1: Suppressing the Amount of Supplied Lubricant)

In lubricant removal operation during the refresh mode, it is preferable to configure such that the amount of lubricant to be supplied to the photoreceptor 1 is decreased to a lower level or zero. Suppressing the amount of lubricant supplied enables efficient removal of the lubricant. That is, when removing lubricant on the photoreceptor 1, the control unit 50 of the image forming apparatus 100 according to the present embodiment controls a lubricant supply mechanism (lubricant supply unit) so as to suppress the amount of supplied lubricant.

As a specific configuration to suppress the amount of supplied lubricant, particularly in a configuration in which the lubricant supply mechanism (for example, the lubricant supply unit 8, and the leveling member 9, as illustrated in FIG. 2) is provided separately from the developing unit 4, it is possible to arrange such that contact pressure of lubricant supply unit 8 against the photoreceptor 1 is weakened, or the lubricant supply unit 8 is spaced from the photoreceptor 1.

As the lubricant supply unit 8 illustrated in FIGS. 2 and 3, in a configuration in which lubricant is scraped from a solid lubricant 84 by using the application brush 81 and the lubricant is applied to the photoreceptor 1, it is possible to suppress the amount of supplied lubricant by lowering the rotation speed of the application brush 81 and/or by weakening the contact pressure of the application brush 81 against the solid lubricant 84.

(k2: Controlling Image Pattern)

In removing lubricant in the refresh mode, a toner image indicating a predetermined image pattern is formed on the photoreceptor 1 by the developing unit 4. The lubricant is then scraped together with the formed toner image. As an image pattern to be used for this process, it is preferable to use an image pattern on which toner exists in all areas in a rotational shaft direction. For example, as the image pattern, it is possible to use a solid pattern in which toner exists in all areas in the rotational shaft direction. That is, in the refresh mode, the control unit 50 uses an image pattern in which toner exists in all areas in the rotational shaft direction of the photoreceptor 1, namely the image bearing body. The image pattern is not limited to the solid pattern. It is possible to use a dot-half pattern, or pale whole-solid pattern formed by controlling a developing bias, or the like.

(k3: Controlling Transfer Conditions)

The toner image (image pattern) formed at the developing unit 4 comes in contact with the intermediate transfer belt 12. At this time, it is preferable to appropriately control transfer conditions to increase the amount of toner to be supplied to the cleaning blade 5 compared with the amount for the time of usual image forming. In other words, it is preferable to decrease the amount of toner transferred to the intermediate transfer belt 12, in view of enhancing removal capability. More specifically, the control unit 50 controls the transfer conditions at the intermediate transfer body contact roller 6 and at a related member (transfer unit) such that the amount of toner that reaches the cleaning blade 5 in the refresh mode is greater than the amount of toner that reaches the cleaning blade 5 in usual image forming. As a means to control the above-described transfer conditions, it is effective to control the transfer bias. For example, by using a technique of weakening a transfer electric field to a level lower than a transfer bias at the time of usual image formation, or controlling the transfer bias so as to reverse a polarity of the transfer electric field, it is possible to increase the amount of toner that reaches the cleaning blade 5, compared with a case in usual image formation.

As another means to control the transfer conditions, it is possible to configure to control a contact pressure at the time of transfer. More specifically, during execution of the refresh mode, it is possible to employ techniques such as decreasing the contact pressure of the intermediate transfer body contact roller 6 compared with the case of usual image forming, or arranging the intermediate transfer body contact roller 6 to be spaced from the intermediate transfer belt 12.

(k4: Adjusting the Amount of Charge)

To the toner image generated on the photoreceptor 1 that has passed through the intermediate transfer belt 12, a certain amount of charge is applied by using a secondary charging unit 7 (charging unit) arranged in front of the cleaning blade 5. An absolute value of the amount of charge that is charged by the secondary charging unit 7 is set to a value higher than the absolute value of the amount of charge at usual image forming. More specifically, a voltage having a same polarity as toner's normal charge polarity (charge polarity retained at the time of image forming) is applied to the secondary charging unit 7 in order that the amount of charge on toner may increase while maintaining its normal charge polarity. In this manner, it is preferable to increase, by using the secondary charging unit 7 (charging unit), the amount of charge on toner that reaches the cleaning blade 5 (cleaning member) compared with the case of usual image forming, and to enhance a capability of removing the lubricant on the photoreceptor 1.

As specific implementation, a charging unit configured to change the amount of charge on toner is provided separately from the developing unit 4, at a portion between the developing unit 4 and the cleaning blade 5. In configurations illustrated in FIGS. 2 to 4, the secondary charging unit 7 corresponds to the charging unit. The secondary charging unit 7 is arranged at a portion between the developing unit 4 (developing unit) and the cleaning blade 5 (cleaning member), along a surface of the photoreceptor 1 (image bearing body). As the secondary charging unit 7, any type of configuration may be employed as long as it can control the amount of charge on toner. Typically, it is preferable to use a corotron charger or a corona charger. The voltage applied to the secondary charging unit 7 may be a DC voltage or the DC voltage superposed with an AC voltage.

The configuration may be such that charging by the secondary charging unit 7 is performed in a limited period during execution of the refresh mode. Alternatively, it is possible to configure to execute charging by the secondary charging unit 7 also in usual image forming so as to adjust conditions for the toner image formed during usual image forming. In a case where charging by the secondary charging unit 7 is performed during usual image forming, it is configured such that charging in the refresh mode is more powerful (with higher absolute value of applied voltage, and/or with greater supply current to the secondary charging unit 7) than a case of usual image forming. With this configuration, toner with a larger amount of charge is supplied to the cleaning blade 5 compared with the case of usual image forming.

Using any of the above techniques, the control unit 50 controls such that the absolute value of the amount of charge on toner that reaches the cleaning blade 5 in the refresh mode becomes higher than the absolute value of the amount of charge on toner to reach the cleaning blade 5 in usual image forming.

(k5: Finishing Processing of Lubricant Removal)

It is preferable to configure such that, when it is determined that the predetermined amount of toner has been supplied to the cleaning blade 5, supply of toner and charging by the secondary charging unit 7 are discontinued and then the photoreceptor 1 is rotated for the predetermined number of times. This rotation enables reducing unevenness in the amount of adhered lubricant in the rotational shaft direction.

<L. Lubricant Supply Function (Lubricant Application Operation)>

Next, a function of supplying lubricant on the photoreceptor 1 of the image forming apparatus 100 according to the present embodiment (step S112 in FIG. 8) will be described.

During application of lubricant in the refresh mode, it is configured to start supplying lubricant or further increase the amount of supplied lubricant onto the photoreceptor 1. In a configuration in which a lubricant supply mechanism is provided separately from the developing unit 4 (for example, the lubricant supply unit 8 and the leveling member 9 as illustrated in FIG. 2), lubricant supply operation includes stopping toner supply by the developing unit 4, causing the lubricant supply unit 8 to be press-contacted against the photoreceptor 1, and rotating the photoreceptor 1 for the predetermined number of times. At this time, contrary to the case of lubricant removal operation, by increasing contact pressure of the application brush 81 against the solid lubricant 84, and/or by increasing the rotation speed of the application brush 81, it is possible to supply lubricant across an appropriate region of the photoreceptor 1 more efficiently, namely, with less numbers of rotation of the photoreceptor 1.

In the refresh mode according to the present embodiment, supply or removal of lubricant is selectively executed so as to achieve the proper frictional force range. Alternatively, it is possible to change the amount of supplied lubricant depending on a deviation of the proper frictional force range. For example, it is possible to configure to increase the amount of supplied lubricant when the measured static frictional force is relatively far from the proper frictional force range. On the other hand, it is possible to configure to decrease the amount of supplied lubricant when the measured static frictional force is relatively close to the proper frictional force range. As a specific technique, it is possible to adjust the amount of supplied lubricant by changing the rotation speed of the application brush 81 according to deviation of the static frictional force. Alternatively, it is possible to adjust the amount lubricant supplied by changing concentration of the lubricant supplied according to deviation of the static frictional force.

<M. Change in the Amount of Applied Lubricant>

The present inventors have found experimentally that, when the predetermined numbers of sheets have been printed on an image forming apparatus 100, the amount of applied lubricant on the photoreceptor 1 increases or decreases, in some cases, with respect to the proper lubricant range.

(m1: Case where the Amount of Applied Lubricant has Increased after Printing the Predetermined Number of Sheets)

It has been found that, when the amount of applied lubricant has increased compared with the proper lubricant range, after printing the predetermined number of sheets, the increase depends on an installation environment of the image forming apparatus 100 and on an image pattern to be used.

The present inventors, as an experimental example, have consecutively printed 1000 sheets containing an image pattern with the B/W ratio of 5% at an installation environment of a room temperature of 30° C. and humidity of 70%. For this experiment, an image forming apparatus 100 illustrated in FIG. 3 has been used.

As illustrated in FIG. 3, lubricant is applied onto the photoreceptor 1 using the lubricant supply unit 8, before passing through the cleaning blade 5. In this experimental example, the measured static frictional force after printing 1000 sheets has increased compared with a usual state. This is considered to be caused by the increasing amount of applied lubricant, at initial stage of printing or in high-temperature/high-humidity environment, and the increased amount of lubricant passes through the cleaning blade 5 to excessively remain on the photoreceptor 1. Therefore, in this case, it is preferable to decrease the amount of lubricant supplied onto the photoreceptor 1.

(m2: Case where the Amount of Applied Lubricant has Decreased after Printing Predetermined Number of Sheets)

In another experimental example, the present inventors have consecutively printed 1000 sheets containing an image pattern with the B/W ratio of 3% at an installation environment of a room temperature of 15° C. and humidity of 20%. For this experiment, an image forming apparatus 100 illustrated in FIG. 4 has been used. In this experimental example, the measured static frictional force after printing 1000 sheets has increased compared with a usual state. Due to a fact that the lubricant is adhered to the toner, it is estimated that, when an image pattern with a lower B/W ratio has been printed, the limited amount of lubricant that has been removed from the toner would remain on the photoreceptor 1, and accordingly, the amount of applied lubricant on the photoreceptor 1 decreases. Therefore, in this case, it is preferable to increase the amount of lubricant supplied onto the photoreceptor 1.

Moreover, in the image forming apparatus 100 illustrated in FIG. 3, the amount of applied lubricant tends to increase when the lubricant supply unit 8 becomes unclean. In this case, it is also preferable to increase the amount of lubricant supplied onto the photoreceptor 1.

<N. Effect Confirmation Experiment>

Several experiments (Examples 1 to 4 and Comparative Examples 1 and 2) have been executed in order to confirm effects of the refresh mode on the image forming apparatus 100 according to the above-described present embodiment. The result of the experiments will be described below.

Specifically, each of experiments includes, based on the image forming apparatus 100 illustrated in FIG. 2 in each of Examples and Comparative Examples, a procedure including consecutively printing 10000 sheets containing an image pattern of the B/W ratio of 7%, and then executing the refresh mode according to the present embodiment. In the present experiment system, negatively charged toner has been used.

In order to demonstrate a lubricant removal function of the refresh mode, a corotron charger has been employed as the secondary charging unit 7, and −8 kV has been applied. On the other hand, charging by the secondary charging unit 7 has been suspended during lubricant application operation of the refresh mode and during usual image forming operation.

[Initial Setup]

Before executing each of Examples and Comparative Examples, initial setup has been executed for the image forming apparatus 100.

In a state where no lubricant exists on the photoreceptor 1, the static torque has been measured as a value representing a static frictional force generated between the photoreceptor 1 and the cleaning blade 5. The static torque can be represented by a current value of a DC motor that rotationally drives the photoreceptor 1. In the present Examples, an initial current value of the DC motor is 26 mA. Thereafter, the static torque has been measured while lubricant is applied for 1.5 seconds. This operation is repeated, so as to obtain a result of a decreased current value as small as 16 mA at third operation. The initial setup is finished at 18 mA at fourth operation. In this setup, a minimum current value of the DC motor (a value representing the minimum frictional force) has been calculated as 16 mA.

The proper frictional force range is calculated as a range beginning from the minimum frictional force value to a value that is obtained by adding a product of the static frictional force difference $\alpha$ and a coefficient k, to the minimum frictional force. In this example, it is calculated such that the minimum current value 16 mA+0.1×(initial current value 26 mA−minimum current value 16 mA)=17. Accordingly, the proper frictional force range is calculated as a range from 16 to 17 mA. Accordingly, the setting has been performed so as to finish the refresh mode at timing when the current value (static torque/static frictional force) falls within the proper frictional force range. Hereinafter, Examples and Comparative Examples executed under these setup conditions will be described.

FIGS. 9A to 9D are schematic diagrams illustrating a change in the static frictional force property in Examples 1 to 4. FIGS. 10A and 10B are schematic diagrams illustrating a change in the static frictional force property in Comparative Examples 1 and 2. With a method of driving the image forming apparatus 100, it is possible to determine the static frictional force alone. In order to obtain the corresponding amount of applied lubricant, it is appropriate to use measurement methods, in which a portion of the surface of the photoreceptor 1 is cut out, and techniques such as Fourier transform infrared spectroscopy (FT-IR), X-ray photoelectron spectroscopy (ESCA), and X-Ray fluorescence analysis (XRF) are utilized. Measurement of the amount of applied lubricant is a destruction test in which a portion of the surface of the photoreceptor 1 needs to be cut out. Therefore, it would not be practical to perform this test using the image forming apparatus 100. Accordingly the measurement is purely for evaluation to be described below.

EXAMPLE 1

Figure 9A:
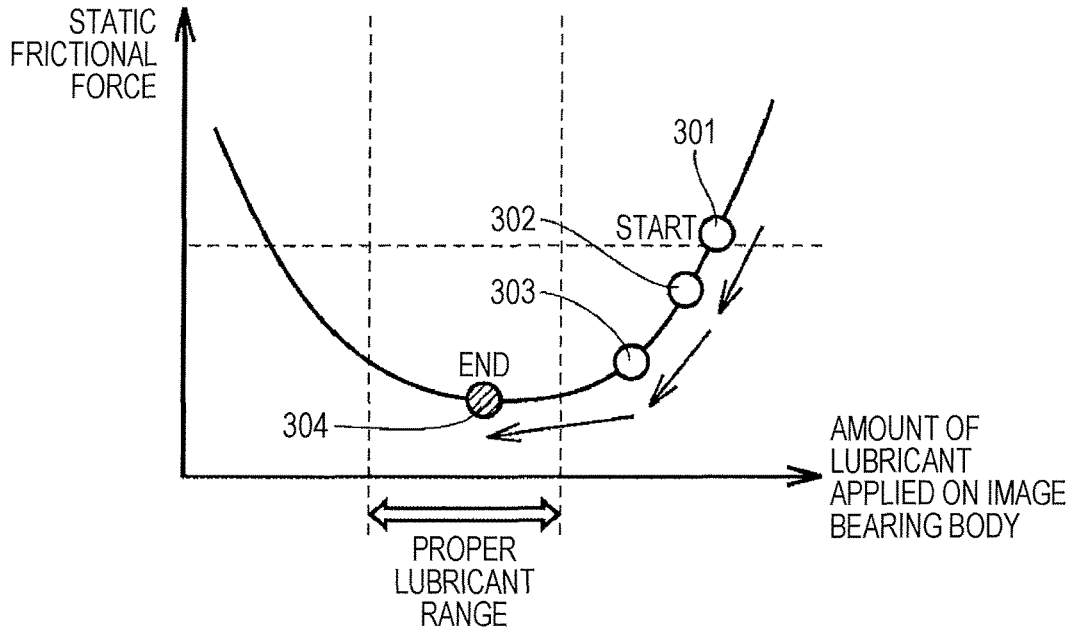
FIGS. 9A to 9D are schematic diagrams illustrating a change in the static frictional force property in Examples 1 to 4.
Figure 10A:
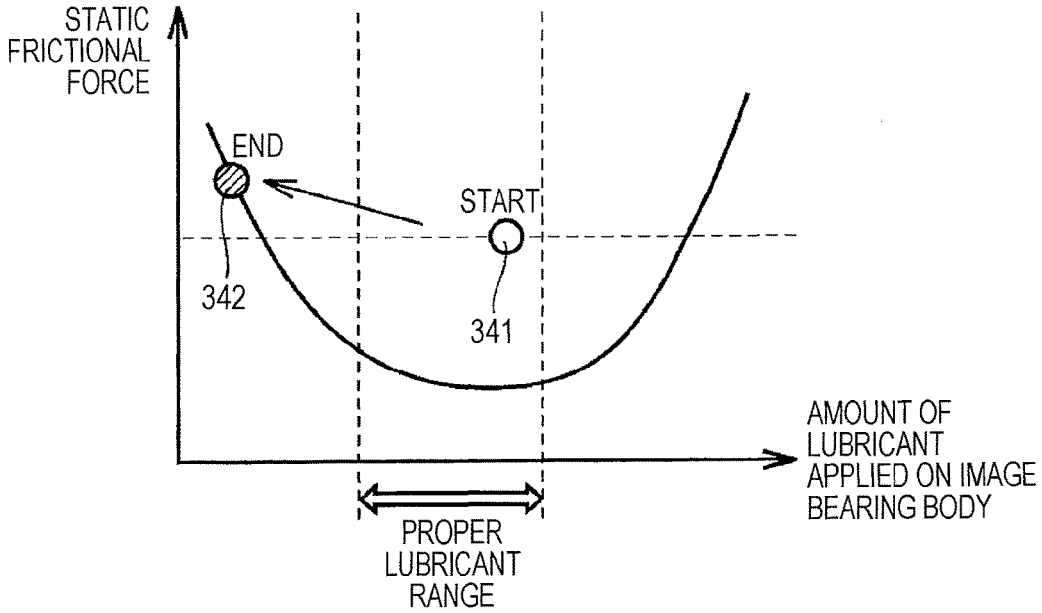
FIGS. 10A and 10B are schematic diagrams illustrating a change in the static frictional force property in Comparative Examples 1 and 2.
Figure 10B:
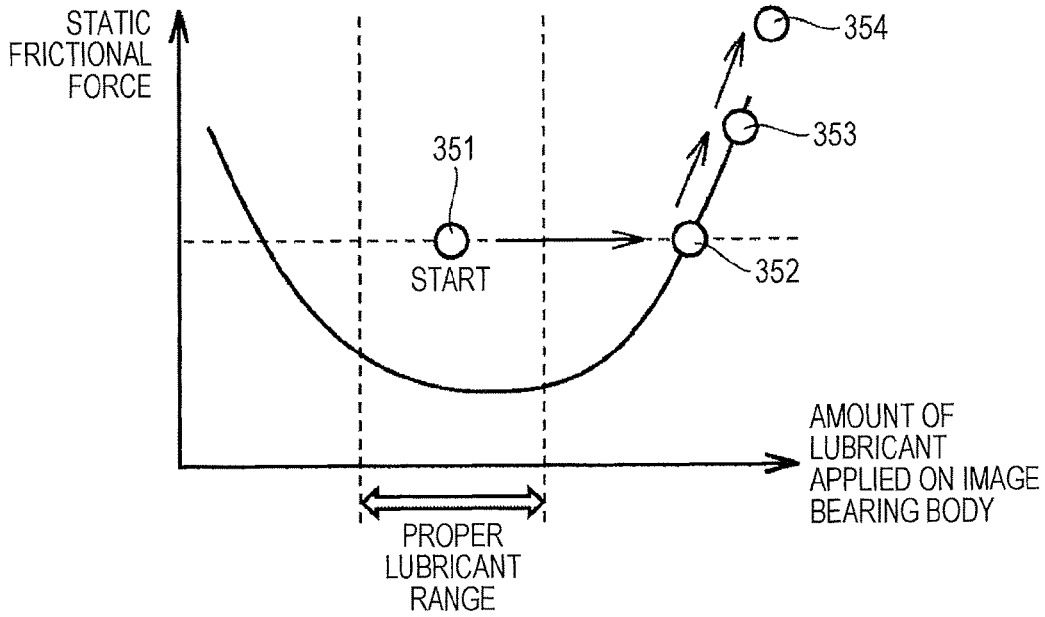

A change in the static frictional force property obtained in Example 1 is illustrated in FIG. 9A.

A current value (static torque/static frictional force) measured immediately after completion of printing the predetermined number (10000) of sheets (status 301) is 20 mA. The current value (static torque/static frictional force) measured after removing the lubricant on the photoreceptor 1 in the refresh mode executed after completion of the printing (status 302) is 19 mA. Compared with 20 mA, the value 19 mA indicates a decrease in the static frictional force. Accordingly, removal of lubricant is executed again.

The current value (static torque/static frictional force) measured after second removal of the lubricant on the photoreceptor 1 (status 303) is 18 mA. Compared with 19 mA, the value 18 mA indicates a decrease in the static frictional force. Accordingly, removal of lubricant is executed again.

The current value (static torque/static frictional force) measured after third removal of the lubricant on the photoreceptor 1 (status 304) is 16 mA. The value 16 mA is within the proper frictional force range. Accordingly, the refresh mode is finished.

After execution of the refresh mode, 10000 sheets have been printed. During this, neither image flow nor defective cleaning has been found.

EXAMPLE 2

Figure 9B:
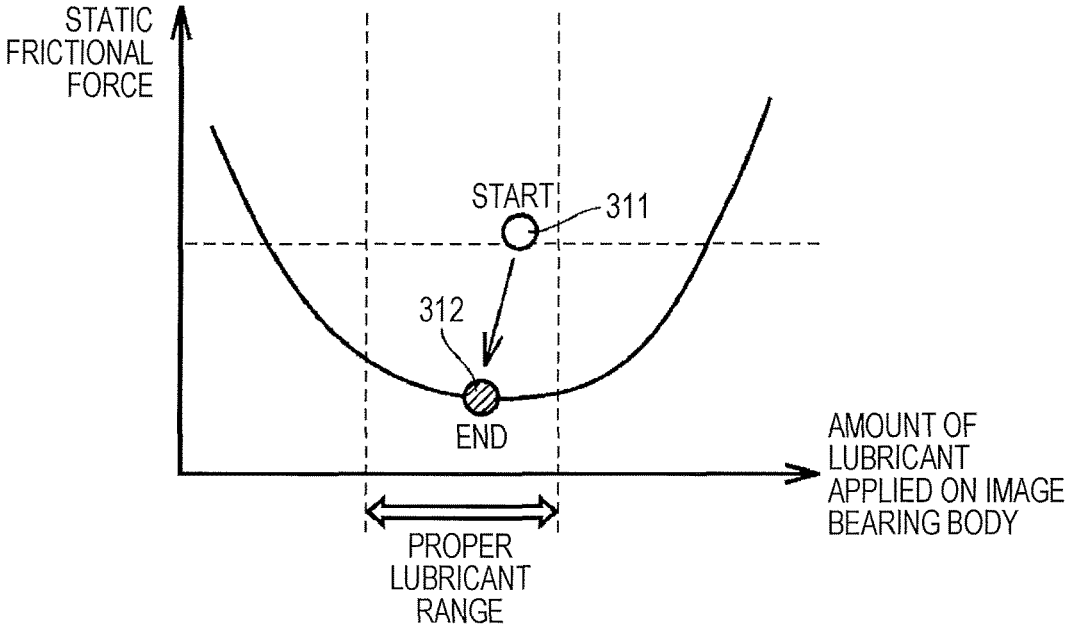

A change in the static frictional force property obtained in Example 2 is illustrated in FIG. 9B.

A current value (static torque/static frictional force) measured immediately after completion of printing the predetermined number (10000) sheets (states 311) is 20 mA. The current value (static torque/static frictional force) measured after removing the lubricant on the photoreceptor 1 in the refresh mode executed after completion of the printing (status 312) is 16 mA. The value 16 mA is within the proper frictional force range. Accordingly, the refresh mode is finished.

After execution of the refresh mode, 10000 sheets have been printed. During this, neither image flow nor defective cleaning has been found.

EXAMPLE 3

Figure 9C:
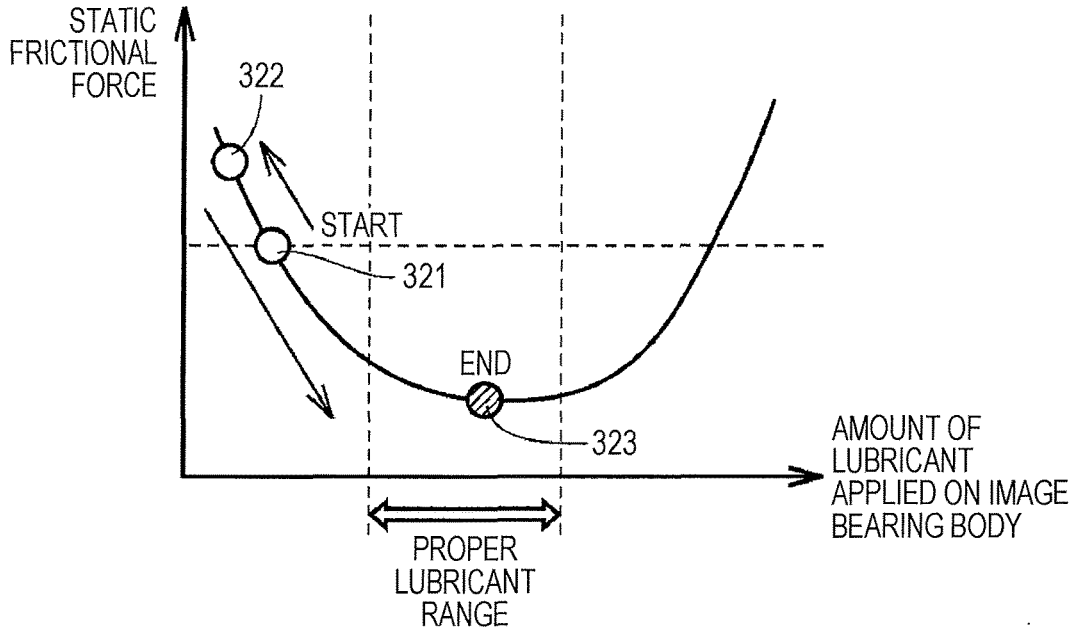

A change in the static frictional force property obtained in Example 3 is illustrated in FIG. 9C.

A current value (static torque/static frictional force) measured immediately after printing the predetermined number (10000) of sheets (states 321) is 20 mA. The current value (static torque/static frictional force) measured after removing the lubricant on the photoreceptor 1 in the refresh mode executed after completion of the printing (status 322) is 21 mA. Compared with 20 mA, the value 21 mA indicates an increase in the static frictional force. Accordingly, this time, application of lubricant is executed.

The current value (static torque/static frictional force) measured after application of lubricant on the photoreceptor 1 (status 323) is 16 mA. The value 16 mA is within the proper frictional force range. Accordingly, the refresh mode is finished.

After execution of the refresh mode, 10000 sheets have been printed. During this, neither image flow nor defective cleaning has been found.

EXAMPLE 4

Figure 9D:
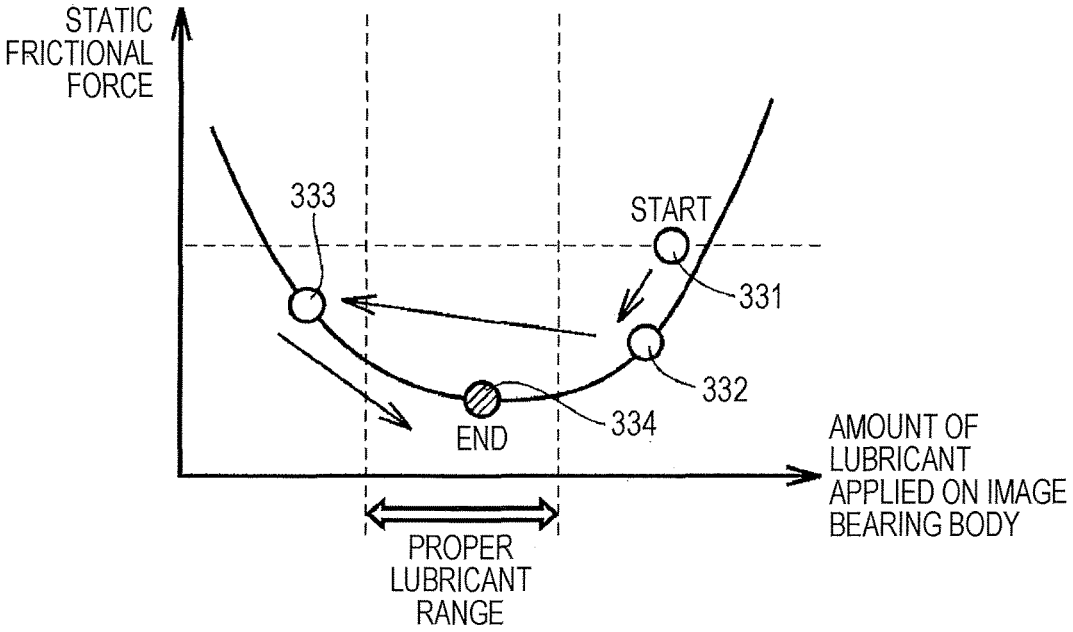

A change in the static frictional force property obtained in Example 4 is illustrated in FIG. 9D.

A current value (static torque/static frictional force) measured immediately after completion of printing the predetermined number (10000) of sheets (states 331) is 20 mA. The current value (static torque/static frictional force) measured after removing the lubricant on the photoreceptor 1 in the refresh mode executed after completion of the printing (status 332) is 18 mA. Compared with 20 mA, the value 18 mA indicates a decrease in the static frictional force. Accordingly, removal of lubricant is executed again.

The current value (static torque/static frictional force) measured after second removal of the lubricant on the photoreceptor 1 (status 333) 19 mA. Compared with 18 mA, the value 19 mA indicates an increase in the static frictional force. Accordingly, this time, application of lubricant is executed.

The current value (static torque/static frictional force) measured after application of lubricant on the photoreceptor 1 (status 334) is 16 mA. The value 16 mA is within the proper frictional force range. Accordingly, the refresh mode is finished.

After execution of the refresh mode, 10000 sheets have been printed. During this, neither image flow nor defective cleaning has been found.

COMPARATIVE EXAMPLE 1

In Comparative Example 1, removal of lubricant alone is executed and application of lubricant is not executed, in the refresh mode. A change in the static frictional force property obtained in Comparative Example 1 is illustrated in FIG. 10A.

A current value (static torque/static frictional force) measured immediately after completion of printing a predetermined number (10000) of sheets (status 341) is 20 mA. The current value (static torque/static frictional force) measured after removing the lubricant on the photoreceptor 1 in the refresh mode executed after completion of the printing (status 342) is 23 mA. As seen from the level of the current value, it is determined that lubricant has been sufficiently removed and the refresh mode is finished.

After execution of the refresh mode, 500 sheets have been printed. As a result, defective cleaning due to excessive scraping of the cleaning blade 5 has occurred.

COMPARATIVE EXAMPLE 2

In Comparative Example 2, application of lubricant alone is executed and removal of lubricant is not executed, in the refresh mode. A change in the static frictional force property obtained in Comparative Example 2 is illustrated in FIG. 10B.

A current value (static torque/static frictional force) measured immediately after completion of printing a predetermined number (10000) of sheets (status 351) is 20 mA. In the refresh mode executed after completion of the printing, it is determined that the amount of applied lubricant is insufficient and lubricant has been applied. The current value (static torque/static frictional force) measured after application of lubricant on the photoreceptor 1 (status 352) is 20 mA. Based on the level of the current value, it is determined that application of lubricant is not sufficient, and application of lubricant is executed again.

The current value (static torque/static frictional force) measured after second application of lubricant on the photoreceptor 1 (status 353) is 22 mA. Based on the level of the current value, it is determined that application of lubricant is still insufficient, and application of lubricant is executed again.

The current value (static torque/static frictional force) measured after third application of lubricant on the photoreceptor 1 (status 354) is 24 mA. Based on the level of the current value, it is determined that application of lubricant is still insufficient, and application of lubricant is executed again. Based on the fact that the frictional force has increased regardless of application of lubricant, it is determined that lubricant has been sufficiently applied and the refresh mode is finished.

After execution of the refresh mode, 500 sheets have been printed. As a result, defective cleaning due to excessive scraping of the cleaning blade 5 has occurred.

[Overall Result]

A result of the experiments (Examples 1 to 4 and Comparative Example 1 to 2) will be described in the table below.

TABLE 1

| | WEAR WIDTH | CLEANING PERFORMANCE (500 SHEETS) | CLEANING PERFORMANCE (10000 SHEETS) |
|---|---|---|---|
| EXAMPLE 1 | ○ | ○ | ○ |
| EXAMPLE 2 | ○ | ○ | ○ |
| EXAMPLE 3 | ○ | ○ | ○ |
| EXAMPLE 4 | ○ | ○ | ○ |
| COMPARATIVE EXAMPLE 1 | x | x | — (NOT EXECUTED) |
| COMPARATIVE EXAMPLE 2 | x | x | — (NOT EXECUTED) |

With observation of all edge areas of the cleaning blade 5 using a microscope (VKX100 produced by KEYENCE CORPORATION), an average wear width has been confirmed and blade wear property has been evaluated. The evaluation results of the wear width in the table represent the following.

○: 40 μm or less

Δ: 40 μm to 100 μm x: 100 μm or more

Cleaning performance is evaluated based on color difference ΔE. After completion of the refresh mode, 500 sheets have been printed. At that time, if the condition is good (○), printing operation has continued to reach 10000 sheets. Evaluation results of the cleaning performance in the table represent the following.

○: $\Delta E<2$

Δ: $2\leq\Delta E\leq3$ x: $\Delta E>3$

<O. Appendix>

The image forming apparatus 100 according to another aspect of the present invention includes: an electrostatic latent image forming unit configured to form an electrostatic latent image on an image bearing body; a developing unit configured to develop the electrostatic latent image using toner; a transfer unit configured to transfer the toner to a receiver medium; and a cleaning member configured to collect, by using a blade, the residual toner on the image bearing body after transfer. The image forming apparatus 100 has a function of executing, at predetermined timing, a mode to correct a lubricating state on a photoreceptor 1 (refresh mode). The refresh mode includes a mode of measuring a static frictional force, a lubricant collecting mode of collecting lubricant, and a lubricant application mode of applying and supplying the lubricant to the photoreceptor 1. In the refresh mode, (1) the static frictional force on the photoreceptor 1 is measured when refresh operation is started, (2) the static frictional force on the photoreceptor 1 after a plurality of lubricant scraping operation is executed for a predetermined time (3) measurement results of (1) and (2) are compared and then, the state of lubricant is estimated. According to the estimation, operation of collecting or applying lubricant is executed so as to perform correction.

It is preferable that the image forming apparatus 100 includes a charging control unit for controlling the amount of charging on toner downstream of the developing unit and upstream of a cleaning blade 5. In a lubricant collecting mode, the charging control unit includes a lubricant application mode to apply lubricant, and an output amount in a direction to increase the absolute value of the amount of charging on toner than in the time of image forming.

It is preferable that a means for measuring the static frictional force is a static torque measurement in which the cleaning blade 5 alone is press-contacted against the photoreceptor 1.

It is preferable that in the initial setup of the image forming apparatus 100, the following operation is performed to determine a target value of correction.

(1) measuring and storing a static frictional force when no lubricant exists on the photoreceptor 1.

(2) measuring and storing a static frictional force after execution of lubricant supply for a predetermined time.

(3) repeating operation in (2) for a plurality of times, then, calculating and storing the minimum value of the static frictional force.

(4) obtaining a difference between the minimum value and the static frictional force measured in (2), then, add 10% of the obtained frictional force difference to the minimum value. The value thus obtained is determined as a target value for correction.

<P. Summary>

The image forming apparatus 100 according to the present embodiment executes the refresh mode for correcting excess or deficiency of the amount of applied lubricant. Specifically, every time the predetermined number of sheets are printed, the static frictional force of the photoreceptor 1 is read, and then, it the value has not reached a predetermined value, operation of scraping lubricant on the photoreceptor 1 is performed. After lubricant scraping operation is finished, the static frictional force is measured and the static frictional force values before/after the operation of scraping lubricant on the photoreceptor 1 are compared with each other. Based on this, it is determined which of the operation of scraping lubricant or the operation of applying lubricant is performed. Thereafter, while comparing the static frictional force values before/after operation of scraping or applying the lubricant, the operation of scraping or applying the lubricant is repeated and for each operation, a static frictional force is measured. When the amount of applied lubricant falls in a proper range, the operation is finished.

The image forming apparatus 100 according to the present embodiment executes the refresh mode, thereby adjusting the amount of applied lubricant on the photoreceptor 1. With this configuration, the static frictional force is maintained within a proper range, making it possible to suppress abnormal wear of the cleaning blade 5 due to degradation of lubricant, and excess or deficiency of the amount of applied lubricant.

In the cleaning mode according to the present embodiment, it is controlled such that the absolute value of the amount of charge on toner that reaches the cleaning blade 5 is higher than the amount of charge on toner that reaches the cleaning blade 5 in usual image forming. With this control, it is possible to remove lubricant existing on the photoreceptor 1 more efficiently. Accordingly, it is possible to prevent an increase in the static frictional force due to degraded lubricant and constantly maintain the static frictional force within a proper range. Furthermore, even when the amount of applied lubricant on the photoreceptor 1 is excessive, by using this technique to remove unnecessary lubricant, it is possible to maintain the amount of applied lubricant in a proper range and suppress abnormal wear of the cleaning blade 5.

On the image forming apparatus 100 according to the present embodiment, by measuring its static torque in a state where the cleaning blade 5 alone is in contact with the photoreceptor 1, it is possible to improve precision in measuring the static frictional force. With this configuration, it is possible to facilitate maintaining the amount of applied lubricant on the photoreceptor 1, required to suppress abnormal wear of the cleaning blade 5 within a proper range.

The image forming apparatus 100 according to the present embodiment obtains an initial frictional force (initial static torque) and a minimum frictional force (minimum static torque) at a time of initial setup, and based on these, determines a proper frictional force range. With this processing of calculating the proper frictional force range, it is possible to compensate for an individual difference between each of the image forming apparatuses 100. By compensating for the individual difference, it is possible to improve precision in measuring the static frictional force. With this configuration, it is possible to facilitate maintaining the amount of applied lubricant on the photoreceptor 1, required to suppress abnormal wear of the cleaning blade 5 within a proper range.

Although the present invention has been described and illustrated in detail, it is clearly understood that the same is by way of illustrated and example only and is not to be taken by way of limitation, the scope of the present invention being interpreted by terms of the appended claims. The scope of the present invention is intended to include any modifications within the scope and meaning equivalent to the scope of the claims.

What is claimed is:

1. An image forming apparatus comprising:

an image bearing body;

a developing unit configured to develop an electrostatic latent image formed on the image bearing body as a toner image;

a transfer unit configured to transfer the toner image to a receiver medium;

a cleaning member configured to collect residual toner on the image bearing body after transfer;

a lubricant supply unit configured to supply lubricant onto the image bearing body;

a measurement unit configured to measure a static frictional force generated between the image bearing body and the cleaning member; and a control unit configured to estimate a state of the lubricant on the image bearing body based on a change between a first static frictional force measured by the measurement unit and a second static frictional force measured by the measurement unit after execution of processing of removing which has been executed to remove the lubricant on the image bearing body after the measurement of the first static frictional force, and based on the estimated state of the lubricant, selectively execute one of processing from the options including processing of supplying lubricant onto the image bearing body and processing of removing lubricant on the image bearing body.

2. The image forming apparatus according to claim 1, wherein the control unit repeats measurement of the static frictional force generated on the image bearing body, and the selective execution of the operation from the options including processing of supplying lubricant onto the image bearing body and processing of removing lubricant on the image bearing body until the static frictional force generated on the image bearing body falls within a predetermined range.

3. The image forming apparatus according to claim 2, wherein the control unit measures a third static frictional force in a state where no lubricant exists on the image bearing body, then executes processing of supplying lubricant onto the image bearing body for a plurality of times, and after individual times of execution and at the same time measures a fourth static frictional force, determines a minimum value of the static frictional force based on the plurality of measured values of the fourth static frictional force, and determines a proper frictional force range based on the third static frictional force and the minimum value of the static frictional force.

4. The image forming apparatus according to claim 3, wherein the control unit determines the minimum value of the static frictional force as a lower limit value of the proper frictional force range, and determines an upper limit value of the proper frictional force range by adding a value obtained by multiplying a predetermined coefficient with a difference between the third static frictional force and the minimum value of the static frictional force, to the minimum value of the static frictional force.

5. The image forming apparatus according to claim 1, wherein the measurement unit measures a startup torque at a time of rotational driving of the image bearing body, to be determined as the static frictional force, in a state where a cleaning blade configuring the cleaning member alone is press-contacted against the image bearing body.

6. The image forming apparatus according to claim 1, further comprising:

a charging unit being arranged along a surface of the image bearing body, at a portion between the developing unit and the cleaning member, wherein the control unit, by using the charging unit, increases the amount of charge on toner that reaches the cleaning member compared with the case of usual image forming and thus removes the lubricant on the image bearing body.

7. The image forming apparatus according to claim 1, wherein the control unit, when removing the lubricant on the image bearing body, controls the lubricant supply unit so as to suppress supply of the lubricant.

8. An image forming method on an image forming apparatus, the image forming apparatus comprising:

an image bearing body;

a developing unit configured to develop an electrostatic latent image formed on the image bearing body as a toner image;

a transfer unit configured to transfer the toner image to a receiver medium;

a cleaning member configured to collect residual toner on the image bearing body after transfer; and a lubricant supply unit configured to supply lubricant onto the image bearing body, the image forming method comprising:

measuring a first static frictional force generated between the image bearing body and the cleaning member;

removing the lubricant on the image bearing body after measurement of the first static frictional force, and measuring a second static frictional force generated between the image bearing body and the cleaning member after the removing; and estimating a state of the lubricant on the image bearing body based on a change between the first static frictional force and the second static frictional force, and based on the estimated state of the lubricant, executing one of processing selectively from the options including processing of supplying lubricant onto the image bearing body and processing of removing lubricant on the image bearing body.

9. The image forming method according to claim 8, wherein measurement of the static frictional force generated on the image bearing body, and the selective execution of the operation from the options including processing of supplying lubricant onto the image bearing body and processing to remove lubricant on the image bearing body are repeated until the static frictional force generated on the image bearing body falls within a predetermined range.

10. The image forming method according to claim 9, comprising:

measuring a third static frictional force in a state where no lubricant exists on the image bearing body, executing processing of supplying lubricant onto the image bearing body for a plurality of times after measurement of the third static frictional force, and after individual execution, measuring a fourth static frictional force, determining a minimum value of the static frictional force based on the plurality of measured values of the fourth static frictional force, and determining a proper frictional force range based on the third static frictional force and the minimum value of the static frictional force.

11. The image forming method according to claim 10, comprising:

determining the minimum value of the static frictional force as a lower limit value of the proper frictional force range, and determining an upper limit value of the proper frictional force range by adding a value obtained by multiplying a predetermined coefficient with a difference between the third static frictional force and the minimum value of the static frictional force, to the minimum value of the static frictional force.

12. The image forming method according to claim 8, comprising measuring a startup torque at a time of rotational driving of the image bearing body to be determined as the static frictional force in a state where a cleaning blade configuring the cleaning member alone is press-contacted against the image bearing body.

13. The image forming method according to claim 8, wherein the image forming apparatus further comprises:

a charging unit arranged along a surface of the image bearing body, at a portion between the developing unit and the cleaning member, the image forming method comprising, by using the charging unit, increasing the amount of charge on toner that reaches the cleaning member than a case of usual image forming, and then removing lubricant on the image bearing body.

14. The image forming method according to claim 8, wherein when the lubricant on the image bearing body is removed, supply of lubricant is suppressed.

15. The image forming apparatus according to claim 1, wherein the control unit is configured to:

execute the processing of removing the lubricant on the image bearing body in a case where the second static frictional force is smaller than the first static frictional force, and execute the processing of supplying the lubricant onto the image bearing body in a case where the second static frictional force is larger than the first static frictional force.

16. The image forming method according to claim 8, wherein:

the processing of removing the lubricant on the image bearing body is executed in a case where the second static frictional force is smaller than the first static frictional force, and the processing of supplying the lubricant onto the image bearing body is executed in a case where the second static frictional force is larger than the first static frictional force.

* * * * *